US005562783A

United States Patent [19]

Inoue et al.

[11] Patent Number: 5,562,783

[45] Date of Patent: Oct. 8, 1996

[54] ALLOY SHEET FOR SHADOW MASK

[75] Inventors: Tadashi Inoue; Kiyoshi Tsuru; Michihito Hiasa; Tomoyoshi Okita, all of Kawasaki, Japan

[73] Assignee: NKK Corporation, Tokyo, Japan

[21] Appl. No.: 178,088

[22] Filed: Jan. 6, 1994

Related U.S. Application Data

[63] Continuation-in-part of Ser. No. 7,755, Jan. 22, 1993, Pat. No. 5,456,771.

[30] Foreign Application Priority Data

| | | | |
|---|---|---|---|
| Jan. 24, 1992 | [JP] | Japan | 4-032941 |
| Sep. 24, 1992 | [JP] | Japan | 4-279542 |
| May 28, 1993 | [JP] | Japan | 5-151351 |
| Sep. 2, 1993 | [JP] | Japan | 5-218713 |

[51] Int. Cl.[6] ..... C22C 38/08; C22C 38/54

[52] U.S. Cl. ..... 148/310; 148/336; 420/94

[58] Field of Search ..... 420/94, 95; 148/310, 148/336

[56] References Cited

U.S. PATENT DOCUMENTS

| | | | |
|---|---|---|---|
| 4,724,012 | 2/1988 | Inaba et al. | 420/584 |
| 4,751,424 | 6/1988 | Tong | 420/94 |
| 5,127,965 | 7/1992 | Inoue et al. | 148/336 |
| 5,158,624 | 10/1992 | Okiyama et al. | 148/310 |
| 5,207,844 | 5/1993 | Watanabe et al. | 148/546 |
| 5,234,512 | 8/1993 | Inoue et al. | 420/94 |
| 5,234,513 | 8/1993 | Inoue et al. | 420/94 |
| 5,308,723 | 5/1994 | Inoue et al. | 430/23 |

FOREIGN PATENT DOCUMENTS

| | | | |
|---|---|---|---|
| 0104453 | 4/1984 | European Pat. Off. . | |
| 0174196 | 3/1986 | European Pat. Off. . | |
| 0552800 | 7/1993 | European Pat. Off. . | |
| 0561120 | 9/1993 | European Pat. Off. . | |
| 2664908 | 1/1992 | France . | |
| 2668498 | 4/1992 | France . | |
| 36 36 815 | 5/1987 | Germany . | |
| 36 42 205 | 1/1988 | Germany . | |
| 59-59861 | 4/1984 | Japan | 420/95 |
| 61-19737 | 1/1986 | Japan . | |
| 61-113747 | 5/1986 | Japan . | |
| 63-259054 | 10/1988 | Japan . | |
| 64-52024 | 2/1989 | Japan . | |
| 3-197645 | 8/1991 | Japan . | |
| 3-267320 | 11/1991 | Japan . | |
| 91/12345 | 8/1991 | WIPO . | |

OTHER PUBLICATIONS

Patent Abstracts of Japan, vol. 10, No. 296 (C–377), Oct. 8, 1986 of JP 61–113747 (Nippon Mining Co., Ltd.), May 31, 1986.

Patent Abstracts of Japan, vol. 15, No. 461 (C–0887), Nov. 22, 1991 of JP 3–197645 (Nippon Mining Co., Ltd.), Aug. 29, 1991.

(List continued on next page.)

*Primary Examiner*—George Wyszomierski

*Attorney, Agent, or Firm*—Frishauf, Holtz, Goodman, Langer & Chick, P.C.

[57] ABSTRACT

An alloy sheet for making a shadow mask consists essentially of 34 to 38 wt. % Ni, 0.07 wt. % or less Si, 0.001 wt. % or less B, 0.003 wt. % or less O, 0.002 wt. % or less N, and the balance being Fe and inevitable impurities.

The alloy sheet has an average austenite grain size (Dav) of 10.5 to 15.0 μm, a ratio of a maximum size to the minimum size of austenite grains (Dmax/Dmin) of 1 to 15, a Vickers hardness (Hv) of 165 to 220 and satisfying a relation of $$10 \times Dav + 80 \geqq Hv \geqq 10 \times Dav + 50;$$

and gathering degree of crystal planes on said alloy sheet surface of

14% or less for {111} plane, 5 to 75% for {100} plane, 5 to 40% for {110} plane, 20% or less for {311} plane, 20% or less for {331} plane, 20% or less for {210} plane, and 20% or less for {211} plane.

49 Claims, 6 Drawing Sheets

OTHER PUBLICATIONS

Patent Abstracts of Japan, vol. 13, No. 69 (C–569), Feb. 16, 1989 of JP 63–259054 (Nippon Mining Co., Ltd.), Oct. 26, 1988.

Patent Abstracts of Japan, vol. 15, No. 461 (C–0887), Nov.22, 1991 of JP 3–197646 (Nippon Mining Co., Ltd.), Aug. 29, 1991.

Patent Abstracts of Japan, vol. 15, No. 92 (C–0811), Mar. 6, 1991 of JP 2–305941 (Toyo Kohan Co., Ltd.), Dec. 19, 1990.

Patent Abstracts of Japan, vol. 10, No. 196 (C–377), Oct. 8, 1986 of JP 61–113746 (Nippon Mining Co., Ltd.), May 31, 1986.

Chemical Abstracts, p. 249, No. 133956d of JP–A–60 251 227, vol. 104, No. 16, Apr. 21, 1986.

Database WPIL, Week 8732, Derwent Publications Ltd., London, GB; AN 87–224995; abstract of JP–A1–62 149 851.

Database WPIL, Week 8615, Derwent Publications Ltd., London, GB; AN 86–098295; abstract of JP–A–61 044 126.

Database WPIL, Week 8610, Derwent Publications Ltd., London, GB; AN 86–066609; abstract of JP–A–61 019 737.

ALLOY SHEET FOR SHADOW MASK

This application is a continuation-in-part application of application Serial No. 08/007,755 filed Jan. 22, 1993, now U.S. Pat. No. 5,456,771 which is incorporated herein in its entirety by this reference.

BACKGROUND OF THE INVENTION

1. Field of the Invention

The present invention relates to an alloy sheet for shadow mask having high press-formability, 2. Description of the Related Arts Recent up-grading trend of color television toward high definition TV has employed Fe—Ni alloy containing 34 to 38 wt. % Ni as the alloy for making a shadow mask to suppress color-phase shift. Compared with low carbon steel which has long been used as a shadow mask material, conventional Fe—Ni alloy has a considerably lower thermal expansion coefficient. Accordingly, a shadow mask made of conventional Fe—Ni alloy raises no problem of a color-phase shift coming from the thermal expansion of shadow mask even when an electron beam heats the shadow mask, The common practice of making the alloy sheet for a shadow mask includes the following steps. An alloy ingot is prepared by a continuous casting process or ingot-making process. The alloy ingot is subjected to slabbing, hot-rolling, cold-rolling, and annealing to form an alloy sheet.

The alloy sheet for the shadow mask is then processed usually in the following steps to form a shadow mask. (1) The alloy sheet is photo-etched to form passage-holes for the electron beam on the alloy sheet for the shadow mask. The alloy sheet for the shadow mask perforated by etching is hereinafter referred to as "flat mask". (2) The flat mask is subjected to annealing. (3) The annealed flat mask is pressed into a curved shape of a cathode ray tube. (4) The press-formed flat mask is assembled to a shadow mask which is then subjected to a blackening treatment.

Since the shadow mask material of conventional Fe—Ni alloy prepared by cold-rolling, re-crystallization annealing, and finish-rolling has a higher strength than a conventional low carbon steel shadow mask material, it is softened by softening-annealing (annealing before pressing) at a temperature of 800° C. or higher temperature for securing the good press-formability after perforation by etching. The softening at a high temperature of 800° C. is, however, not favorable from the viewpoint of work efficiency and also of economy. Accordingly, the industry waits for the development of materials which provide a strength as low as the material having been softened at the temperature of 800° C. or higher even if they are subjected to softening at a low temperature.

Improvement of press-fore, ability of an INVAR alloy for a shadow mask was disclosed in the Japanese Unexamined Patent Publication No. 3-267320. This prior art provides a technology to reduce strength under a low temperature softening annealing at below 800° C., where an alloy is treated by cold-rolling, recrystallization annealing, and finish cold-rolling at the reduction ratio of 5 to 20 wt %. The temperature of softening is below 800° C. The prior art produces a sheet having sufficiently low strength to give good press-formability with the 0.2 wt % proof stress of 9.5 kgf/mm$^2$ (less than 10 kgf/mm$^2$) at 200° C. by the softening annealing at the temperature of less than 800° C.

However, the technology disclosed in the Japanese Unexamined Patent Publication No. 3-267320 only focuses on the average grain size and strength, and the disclosed process induces a considerable increase of degree of {100} plane and generates a mixed grain structure. As a result, the shadow masks prepared by the prior art were found to gall the dies during press-forming and easily generate cracks at the edge of shadow masks. In addition, the material prepared by the prior art gave large plane anisotropy to induce a blurred periphery of pierced holes of the shadow mask after press-forming, which raised quality problems.

SUMMARY OF THE INVENTION

The object of the present invention is to provide an alloy sheet for making a shadow mask which has a superior press-formability which offers a high screen quality without inducing color-phase shift.

To achieve the object, the present invention provides an alloy sheet for shadow mask consisting essentially of 34 to 38 wt. % Ni, 0.07 wt. % or less Si, 0.001 wt. % or less B, 0.003 wt. % or less O, 0.002 wt. % or less N, and the balance being Fe and inevitable impurities;

said alloy sheet before annealing before press-forming having an average austenite grain size (Dav) of 10.5 to 15.0 μm, a ratio of a maximum size to a minimum size of austenite grains (Dmax/Dmin) of 1 to 15, a Vickers hardness (Hv) of 165 to 220 and satisfying a relation of $$10\times Dav+80 \geqq Hv \geqq 10\times Dav+50;$$

and said alloy sheet having gathering degrees of crystal plane on the alloy sheet surface of
14% or less for {111} plane,
5 to 75% for {100} plane,
5 to 40% for {110} plane,
20% or less for {311} plane,
20% or less for {331} plane,
20% or less for {210} plane, and
20% or less for {211} plane.

Said alloy sheet may include 1 wt. % or less Co.

Furthermore, the present invention provides an alloy sheet for making a shadow mask consisting essentially of 28 to 38 wt. % Ni, 0.07 wt. % or less Si, over 1 wt. % to 7 wt. % Co, 0.001 wt. % or less B, 0.003 wt. % or less O, 0.002 wt. % or less N, and the balance being Fe and inevitable impurities;

said alloy sheet before annealing before press-forming having an average austenite grain size (Dav) of 10.5 to 15.0 μm, a ratio of a maximum size to a minimum size of austenite grains (Dmax/Dmin) of 1 to 15, a Vickers hardness (Hv) of 165 to 220 and satisfying a relation of $$10\times Dav+80 \geqq Hv \geqq 10\times Dav+50;$$

and said alloy sheet having gathering degrees of crystal planes on the alloy sheet surface of
14% or less for {111} plane,
5 to 75% for {100} plane,
5 to 40% for {110} plane,
20% or less for {311} plane,
20% or less for {331} plane,
20% or less for {210} plane, and
20% or less for {211} plane.

Still further, the present invention provides an alloy sheet for making a shadow mask consisting essentially of 34 to 38 wt. % Ni, 0.01 to 3 wt. % Cr, 0.2 wt. % or less Si, 0.005 wt. % or less B, 0.004 wt. % or less O, 0.003 wt. % or less N, 0.05 wt. % or less Sb, and the balance being Fe and inevitable impurities;

said alloy sheet before annealing before press-forming having an average austenite grain size (Dav) of 10.5 to 15.0 μm, a ratio of the maximum size to the minimum size of austenite grains (Dmax/Dmin) of 1 to 15, a Vickers hardness (Hv) of 165 to 220 and satisfying the relation of $$10\times Dav+80 \geqq Hv \geqq 10\times Dav+50;$$

said alloy sheet having degrees of crystal planes on the alloy sheet surface of
14% or less for {111} plane,
5 to 75% for {100} plane,
5 to 40% for {110} plane,
20% or less for {311} plane,
20% or less for {331} plane,
20% or less for {210} plane, and
20% or less for {211} plane.

Said alloy sheet may include 1 wt. % or less Co.

Furthermore, the present invention provides an alloy sheet for making a shadow mask consisting essentially of 28 to 38 wt. % Ni, 0.01 to 3 wt. % Cr, over 1 wt. % to 7 wt. % Co, 0.2 wt. % or less Si, 0.005 wt. % or less B, 0.004 wt. % or less O, 0.003 wt. % or less N, 0.05 wt. % or less Sb, and the balance being Fe and inevitable impurities;

said alloy sheet before annealing before press-forming having an average austenite grain size (Dav) of 10.5 to 15.0 μm, having the ratio of a maximum size to a minimum size of austenite grains, Dmax/Dmin, being 1 to 15, having Vickers hardness (Hv) of 165 to 220 and satisfying a relation of $$10\times Dav+80 \geqq Hv \geqq 10\times Dav+50;$$

and said alloy sheet having degrees of crystal planes on the alloy sheet surface of
14% or less for {111} plane,
5 to 75% for {100} plane,
5 to 40% for {110} plane,
20% or less for {311} plane,
20% or less for {331} plane,
20% or less for {210} plane, and
20% or less for {211} plane.

DESCRIPTION OF THE PREFERRED EMBODIMENT

Preferred Embodiment 1

Figure 1:
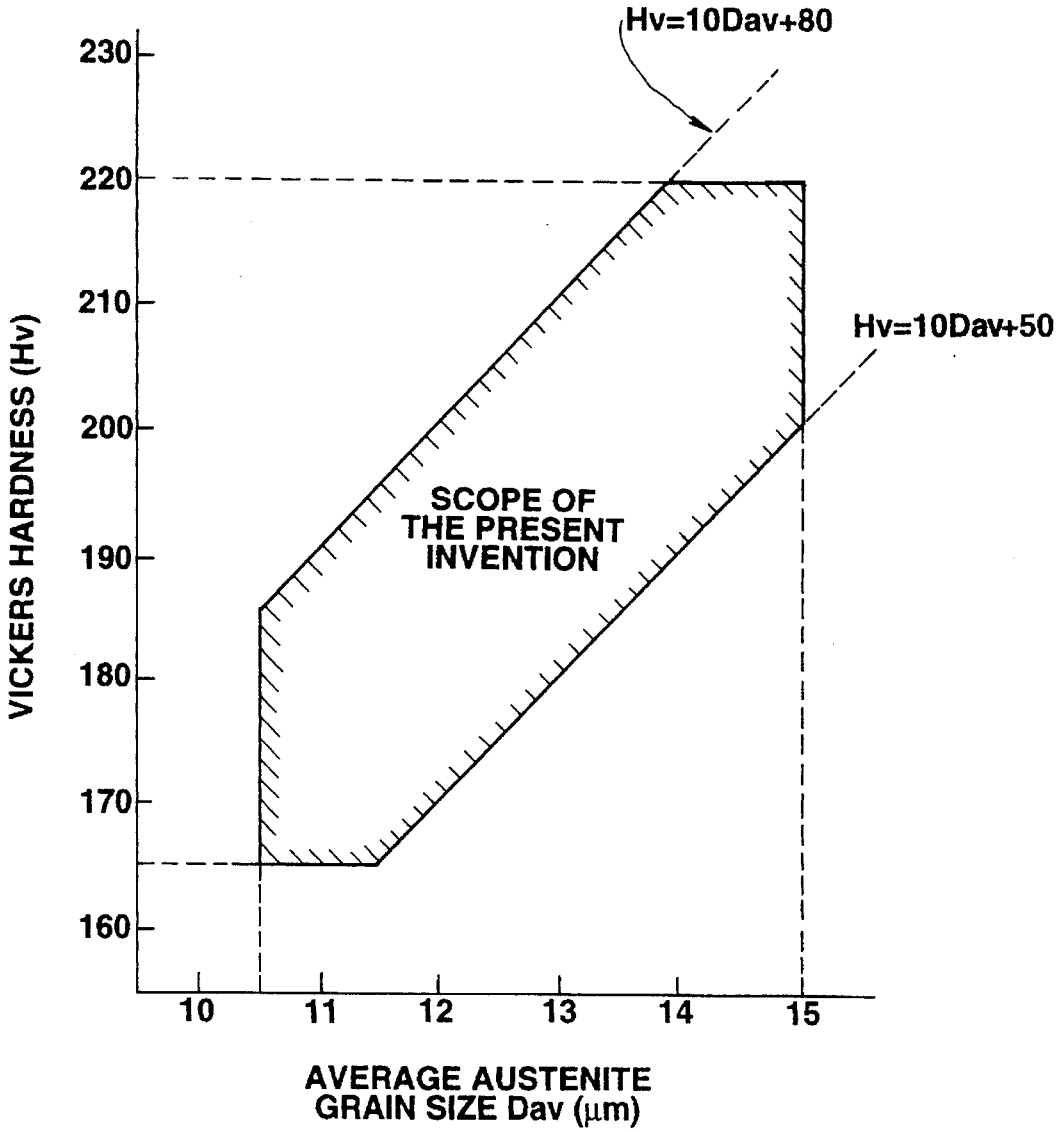
FIG. 1 is a graph showing effects of an average austenite grain size and a Vickers hardness on a press-formability according to the preferred embodiment 1.

An alloy sheet consisting essentially of Fe, Ni, Si, B, O, and N, and an alloy sheet consisting essentially of Fe, Ni, Si, Co, B, O, and N of the present invention are described in the following.

The reason why the composition of the present invention is limited is described below. A Fe—Ni alloy sheet for shadow mask is requested to have the upper limit of average thermal expansion coefficient of $2.0\times(1/10^6)/°$ C. in the temperature range of 30° to 100° C. for the prevention of color-phase shift. The thermal expansion coefficient depends on the Ni content of the alloy, and the Ni content which satisfies the above specified upper limit of the average thermal expansion coefficient is in a range of from 34 to 38 wt. %. Accordingly, the Ni content is specified as 34 to 38 wt. %. For further low average thermal expansion coefficient, the Ni content is preferably adjusted to 35 to 37 wt. %, and most preferably to 35.5 to 36.5 wt. %. Usually, Fe—Ni alloys include Co to some extent as an inevitable impurity, and the Co content of less than 1 wt. % affects very little the characteristics of alloy while the above specified range of Ni content is acceptable. However, a Fe—Ni alloy which contains Co of over 1 wt. % and to 7 wt. % needs to limit the Ni content to be in the range of 28 to 38 wt. % for satisfying the above described condition of average thermal expansion coefficient. Therefore, if the Co content is over 1 wt. % to 7 wt. %, then the Ni content is specified to be in a range of from 28 to 38 wt. %. By adjusting the Co content to be 3 to 6 wt. % and the Ni content to be 30 to 33 wt. %, a superior characteristic giving a lower average thermal expansion coefficient is obtained. If the Co content exceeds 7 wt. %, the thermal expansion coefficient increases to give a superior characteristic, so the upper limit of Co content is specified as 7 wt. %.

Oxygen is one of the inevitable impurities When oxygen content is increased, the non-metallic oxide inclusion increases in the alloy. The non-metallic inclusion suppresses the growth of crystal grains during the annealing before press-forming, particularly at the temperature of less than 800° C. If the content of O exceeds 0.0030 wt. %, the growth of grains is inhibited, and the press-forming quality being aimed by the present invention can not be obtained. In this respect, the present invention specifies the upper limit of O content as 0.0030 wt. %. The lower limit of O content is not specifically limited, but it is substantially selected as 0.0001 wt. % from the economy of ingot-making process.

B improves the hot-workability of the alloy. Excess amount of B, however, induces the segregation of B at the boundary of recrystallized grains formed during annealing before press-forming, which inhibits the free migration of grain boundaries and results in the suppression of grain growth and the dissatisfaction of necessary 0.2 wt. % proof stress after the annealing before press-forming. In particular, under the annealing before press-forming at a relatively low temperature, which is specified in the present invention, the suppression against the grain growth is strong and the action does not uniformly have an effect on all grains. As a result, a severe mixed grain structure appears to be accompanied by an irregular elongation of material during press-forming, which induces a blurred periphery of pierced holes on shadow mask. Boron content above 0.0010 wt. % significantly enhances the suppression of grain growth, and the press-formability aimed in the present invention can not be obtained. Also the problem of blurred periphery of pierced holes arises. Consequently, the present invention specifies the upper limit of B content as 0.0010 wt. %. From the above described viewpoint, the more preferable B content is 0.0002 wt. % or less.

Silicon is added as the deoxidizer element during ingot-making of the alloy. When the Si content exceeds 0.07 wt. %, an oxide film of Si is formed on the surface of alloy at the annealing before press-forming. The oxide film degrades the fitness with dies during press-forming and results in the galling of dies by the alloy sheet. Consequently, the upper limit of Si content is specified as 0.07 wt. %. Further reduction of Si content improves the fitness of dies and the alloy sheet. The lower limit of Si content is not necessarily specified but approximately 0.001 wt. % is the virtual lower limit from the economy of ingot-making process.

Nitrogen is an element unavoidably entering into the alloy during the ingot-making process. Nitrogen content of 0.0020 wt. % or more induces the concentration of N on the surface of alloy during the annealing before press-forming and yields nitride. The nitride degrades the fitness of the alloy with dies during the press-forming process and induces galling of dies by the alloy sheet. Consequently, the N content is specified as less than 0.0020 wt. %. Although the lower limit of N content is not necessarily defined, 0.0001 wt. % is a lower limit from the economy of ingot-making process.

Regarding the elements other than above described, the preferable range of C is 0.0001 to 0.0040 wt. %, that of Mn is 0.001 to 0.35 wt. %, and that of Cr is 0.001 to 0.07 wt. %.

According to the present invention, to improve the shape fixability, to suppress crack generation on the alloy sheet surface during press-forming, and to prevent generation of blurred periphery of pierced holes of a prepared shadow mask, it is necessary to define, in addition to the composition above specified, the specific range for each of an average austenite grain size (Dav) before the annealing before press-forming, a ratio of maximum to minimum size of austenite grains, (Dmax/Dmin) and the Vickers hardness (Hv) and furthermore it is necessary to specify the relation between the Vickers hardness (Hv) and the average austenite grain size (Dav) to satisfy a specific correlation.

FIG. 1 shows the effect of average austenite grain size, Dav, and Vickers hardness, Hv, before the annealing before press-forming on the press-fore, ability. In that case, the alloy was subjected to the annealing before press-foraging at a temperature below 800° C. followed by the press-forming. The employed alloy sheet included: 34 to 38 wt. % Ni, 0.07 wt. % or less Si, 0.001 wt. % or less B, 0.003 wt. % or less O, and below 0.002 wt. % N. The gathering degrees of planes of the alloy was as follows: 14% or less for {111} plane, 5 to 75% for {100} plane, 5 1o40% for {110} plane, 20% or less for {311} plane, 20% or less for {331} plane, 20% or less for {210} plane, and 20% or less for {211} plane. The alloy sheet had a ratio of a maximum size to a minimum size of austenite grains, Dmax/Dmin, in a range of from 1 to 15.

According to FIG. 1, the value of average austenite grain size, Dav, less than 10.5 μm can not enhance the growth of grain in an alloy sheet during the annealing before press-forming under the temperature condition being aimed by the present invention, below 800° C., and increases spring back and results in a poor shape fixability because of the insufficient growth of grains. On the other hand, the value of Dav above 15.0 μm hinders the recrystallization during the annealing before press-forming and results in a poor shape fixability owing to the insufficient recrystallization.

Vickers hardness, Hv, is mainly determined by the reduction ratio of cold-rolling. The value of Hv below 165 can not give sufficient strain to the alloy sheet, and gives only a weak driving force for recrystallization during the annealing before press-forming. The result is insufficient recrystallization, which leaves the alloy sheet at a rather rigid state even after the annealing before press-forming. As a result, the shape fixability is poor. On the other hand, when excess strain is given to the alloy sheet to induce Hv above 220, the driving force for recrystallization during the annealing before press-forming becomes strong, which yields excess frequency of nuclei formation during recrystallization. Consequently, the grains become fine after the annealing before press-forming to degrade the shape fix ability.

FIG. 1 also indicates that an adequate recrystallization during the annealing before press-forming is realized by keeping the relation between Vickers hardness, Hv, and average austenite grain size Dav in a specific range. A large average austenite grain size, Dav, before the annealing before press-forming requires a large degree of strain for obtaining a sufficient driving force during the annealing before press-forming. Accordingly, the lower limit of Vickers hardness, Hv, is necessary to be defined depending on the corresponding average austenite grain size, Dav. On the other hand, since a smaller average austenite grain size, Dav, has results in a larger number of nucleation sites, the upper limit of Vickers hardness, Hv, is necessary to be defined depending on the corresponding average austenite grain size, Dav, to prevent the generation of fine grains after the annealing before press-forming. According to FIG. 1, even the Vickers hardness, Hv, is 165 or more, if the equation of [Hv<10×Dav+50] is satisfied, then the driving force for the recrystallization during the annealing before press-forming is relatively too small, and sufficient recrystallization can not be attained. Therefore, the material remains rigid even after the annealing before press-foraging and is poor in the shape fixability. Even when the Vickers hardness, Hv, is 220 or less, if the equation of [Hv>10×Dav+80] is satisfied, then the driving force for the recrystallization during the annealing before press-forming is relatively too large, the grains become fine after the annealing before press-forming and the shape fixability is poor.

Figure 2:
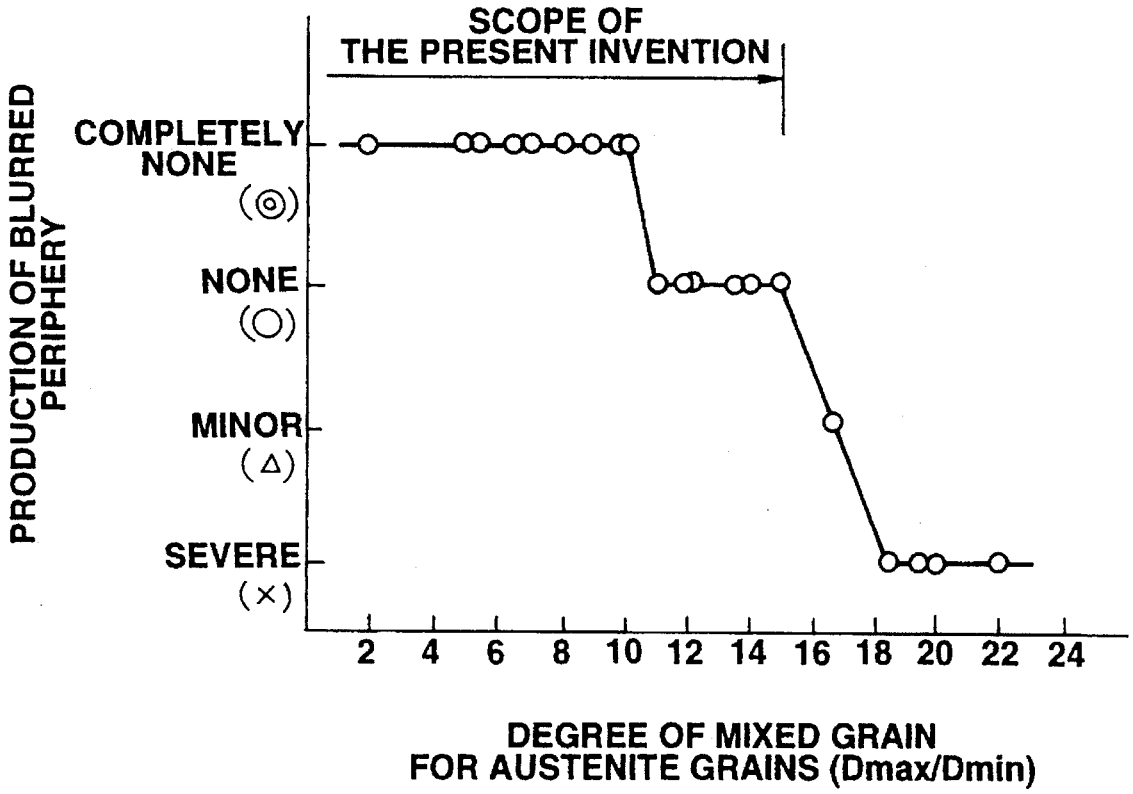
FIG. 2 is a graph showing a relation between a degree of mixed grain for austenite grains and production of a blurred periphery of pierced holes according to the preferred embodiment 1.

FIG. 2 shows the relation between the ratio of the maximum size to the minimum size of austenite grains, Dmax/Dmin, and the blurred periphery of pierced hole. The employed alloy sheet consists essentially of: 34 to 38 wt. % Ni, 0.07 wt. % or less Si, 0.001 wt. % or less B, 0.003 wt. % or less O, and below 0.002 wt. % N.

The Vickers hardness, Hv, and the average austenite grain size, Dav, satisfied the equation:

$$10\times Dav+80 \geqq Hv \geqq 10\times Dav+50$$

The degree of plane of the alloy was as follows: 14% or less for {111} plane, 5 to 75% for {100} plane, 5 to 40% for {110} plane, 20% or less for {311} plane, 20% or less for {331} plane, 20% or less for {210} plane, and 20% or less for {211} plane.

According to FIG. 2, when the ratio of the maximum size to the minimum size of austenite grains, Dmax/Dmin, exceeds 15, the etched hole size becomes irregular and induces blurred periphery of pierced holes. A smaller Dmax/Dmin value is more favorable, and the lower limit of the Dmax/Dmin is specified as 1.

From the consideration given above, the present invention specifies the average austenite grain size, Dav, before the annealing before press-forming as in a range of from 10.5 to 15.0 μm, the ratio of the maximum size to the minimum size of the austenite grains, Dmax/Dmin, (which ratio is hereinafter referred to simply as "degree of austenite mixed grain"), as in a range of from 1 to 15, and the Vickers hardness, Hv, as in a range of from 165 to 220, and also satisfies the following equation:

$$10\times Dav+80 \geqq Hv \geqq 10\times Dav+50$$

for enhancing the growth of grain during the annealing before press-forming, for improving the shape fixability, and for suppressing the blurred periphery of pierced holes of a prepared shadow mask.

For the prevention of crack generation during the press-forming and for the prevention of blurred periphery of pierced hole and partial color-phase shift on the prepared shadow mask, which are the objects of the present invention, it is important to limit the gathering degrees of planes on the alloy sheet surface before annealing before press-forming, as well as the limitations specified above.

The inventors found that the control of the gathering degree of {211} plane on the alloy sheet surface before annealing before press-forming effectively suppresses the crack generation during press-forming and that the control of the degree of {100} plane and {110} plane suppresses the blurred periphery of pierced holes on the prepared shadow mask and that the control of the degree of {111} plane, {311} plane, {331} plane, and {210} plane suppresses the partial color-phase shift on the prepared shadow mask.

In concrete terms, when the degree of {211} plane exceeds 20%, the alloy sheet generates cracks during press-forming. When the degree of {111} plane, {311} plane, {331} plane, and {210} plane exceeds 14%, 20%, 20%, and 20%, respectively, the etched hole shape abnormally deforms during press-forming, which induces partial color-phase shift.

Figure 3:
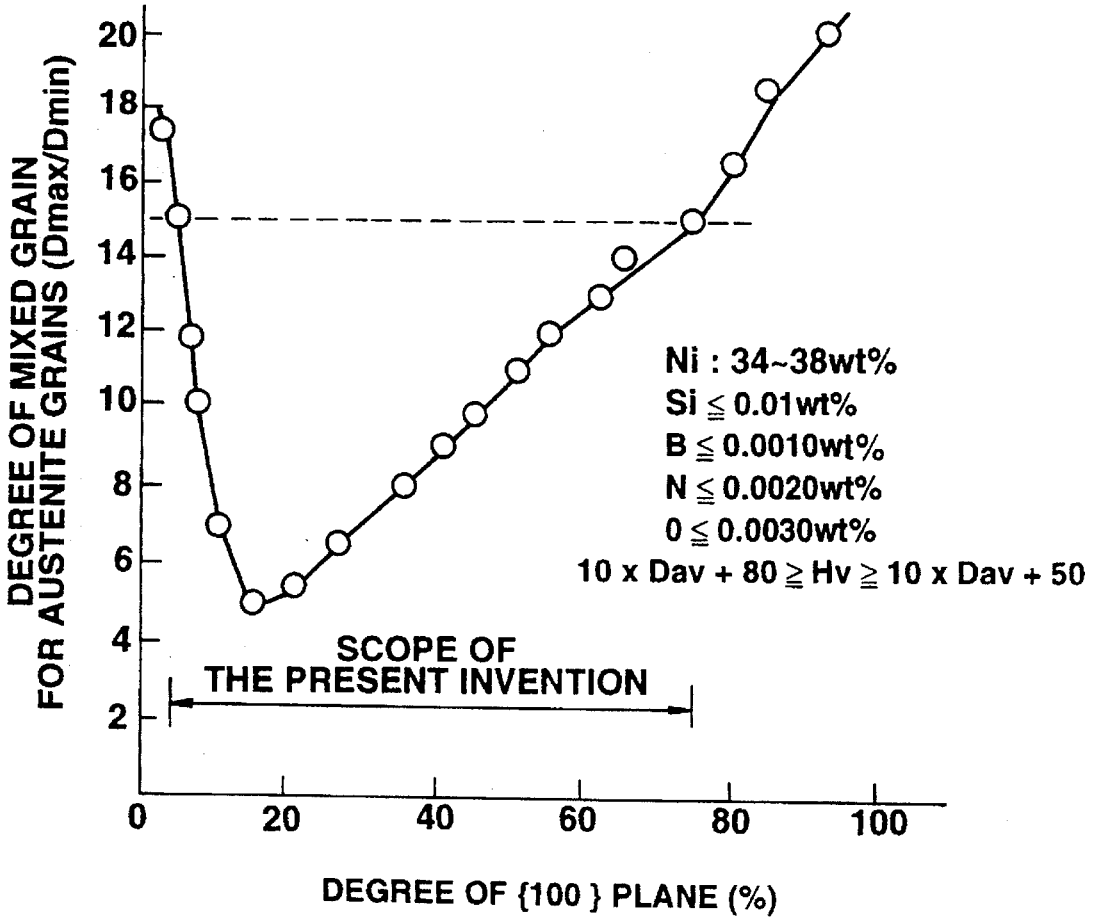
FIG. 3 is a graph showing a relation between a gathering degree of {100} plane and a degree of mixed grain of austenite grains according to the preferred embodiment 1.

The control of the degree of {100} plane and {110} plane is necessary for limiting the degree of austenite mixed grain, Dmax/Drain, in the range specified in the present invention. When the degree of {100} plane exceeds 75% or when the degree of {110} plane exceeds 40%, the degree of austenite mixed grain exceeds 15. In that case, the recrystallization during the annealing before press-forming does not proceed uniformly, and the grains after the annealing before press-forming become a mixed grain state inducing blurred periphery of pierced holes on the prepared shadow mask. When the degree of {100} plane is less than 5%, the degree of {110} plane exceeds 40%. When the degree of {110} plane is less than 5%, the degree of {100} plane exceeds 75%. In both cases, the degree of austenite mixed grain exceeds 15 and induces a blurred periphery of pierced holes on the prepared shadow mask. FIG. 3 shows the relation between the degree of {100} plane and the degree of mixed grain. According to FIG. 3, the degree of austenite mixed grain can be controlled in a range of 1 to 15 by controlling the degree of {100} plane in a range of 5 to 75%. The degree of mixed grain is further reduced by controlling the degree of {100} plane in a further limited range of 8 to 46% for more effective suppression of blurred periphery of pierced hole.

From the consideration given above, the present invention specifies the gathering degree of each plane on the alloy sheet before annealing before press-forming as listed below:

Gathering degree of {111} plane: 14% or less

Gathering degree of {100} plane: 5 to 75%

Gathering degree of {110} plane: 5 to 40%

Gathering degree of {311} plane: 20% or less

Gathering degree of {331} plane: 20% or less

Gathering degree of {210} plane: 20% or less

Gathering degree of {211} plane: 20% or less

The value of the gathering degree given above is the relative rate of each plane to the total gathering degree of planes, {111}, {100}, {110}, {311}, {331}, {210},and {211}.

The gathering degree of respective plane is determined from the X-ray diffraction intensity on each X-ray diffraction plane, (111), (200), (220), (311), (331), (420), and (422). For example, the degree of (111) plane is determined by dividing the relative X-ray diffraction intensity ratio of (111) plane by the sum of relative X-ray intensity ratio on each diffraction plane, (111), (200), (220), (311), (33 1), (420), and (422). The degree of other planes, (100), (110), (311), (331), (210), and (211) can be determined by the same procedure. The relative X-ray diffraction intensity ratio is the ratio of the X-ray diffraction intensity measured on each diffraction plane to the theoretical X-ray intensity on the diffraction plane. For instance, the relative X-ray diffraction intensity ratio of (111) plane is the X-ray diffraction intensity of (111) diffraction plane divided by the theoretical X-ray diffraction intensity of (111) diffraction plane.

The degree of each plane, {100}, {110}, {210}, and {211} is determined from the relative X-ray diffraction intensity ratio of (200), (220), (420), and (422) plane, each of which has the same orientation with corresponding plane, divided by the sum of relative X-ray diffraction intensity ratio of the seven diffraction planes, (111) through (422).

The degree of each plane, {111}, {100}, {110}, {311}, {331}, {210}, and {211}, before the annealing before press-forming, which is specified by the present invention, is normally obtained by selecting adequate conditions of treatment after the hot-rolling step.

For example, when an alloy sheet of the present invention is produced by hot-rolling a slab prepared by slabbing or continuous casting followed by a sequence of annealing of hot-rolled sheet, cold-rolling, recrystallization annealing, cold-rolling, recrystallization annealing, cold-rolling, recrystallization annealing, finish cold rolling, and stress relief annealing, an effective condition to obtain the degree of plane defined above is the control of the annealing temperature during the annealing of hot-rolled sheet at an adequate level in a range of from 910° to 990° C. and furthermore the selection of an optimum condition of cold-rolling, recrystallization annealing, finish cold-rolling, and stress relief annealing. Also for the average austenite grain size, Dav, the degree of austenite mixed grain, Dmax/Dmin, and the Vickers hardness, Hv, specified by the present invention, the optimization is achieved by controlling the conditions of cold-rolling, recrystallization annealing, finish cold-rolling, and stress relief annealing.

To obtain a degree of planes specified by the present invention, the uniform heat treatment of a slab after blooming or after continuous casting is not preferable. For instance, when the homogenization is carried out at 1200° C. or higher temperature and for 10 hours or longer period, the degree of one or more of the planes {111}, {100}, {110}, {311}, {331}, {210}, and {211} dissatisfies the specification of the present invention. Therefore, such a homogenization treatment should be avoided.

Other means may be employed to satisfy the degree of planes specified by the present invention. Quenching to solidify and agglomeration controlling through the control of recrystallization during hot working are some of the examples of applicable means.

The alloy sheet of the present invention may be subjected to the annealing before press-forming before the photo-etching step. If the annealing before press-forming is performed at a relatively low temperature which is a condition of the present invention, the quality of photo-etching is not degraded. In a conventional material, if the photo-etching is applied after the annealing before press-forming at a relatively low temperature specified by the present invention, the quality of the photo-etching is degraded, so the annealing before press-forming is substantially not applicable before the photo-etching. On the contrary, the materials of the present invention accept the photo-etching after the annealing before press-forming without degrading the etching performance.

EXAMPLE 1

The inventors prepared the alloys of No. 1 through No. 23 having the composition listed on Table 1 and Table 2 by ladle refining, and cast the alloys of No. 1 through No. 13 and No. 18 through No. 23 to form ingots. After they are subjected to slabbing, scarfing, and hot-rolling at 1100° C. for 3 hours, the hot-rolled sheets were obtained. The alloys of No. 14 through No. 17 were cast directly into sheets which were then hot-rolled at the reduction ratio of 30% in the temperature range of from 1000° to 1300° C. followed by coiling at 750° C. to obtain the hot-rolled sheets. From these hot-rolled sheets, the alloy sheets of materials No. 1 through No. 34 listed on Table 3 through Table 6 were prepared.

In Table 3 and Table 4, Dmax represents the maximum austenite grain size in the alloy sheet, and Drain represents the minimum austenite grain size in the alloy sheet.

In Table 5 and Table 6, the criteria for evaluation of the shape fixability, the fitness of dies and alloy sheet, and the blurred periphery of pierced hole are the following.

Regarding the shape fixability, "◎" mark indicates "very good", "○" indicates "good", and "X" indicates "rather poor".

As for the fitness to dies and alloy sheet, "○" mark indicates "good without ironing mark", "Δ" indicates "rather poor with a few ironing marks", and "X" indicates "poor with lots of ironing marks".

For the blurred periphery of pierced holes, "◎" mark indicates "definitely none", "○" indicates "none", "Δ" indicates "found some", and "X" indicates "generated".

Materials No. 1 through No. 21 and No. 27 through No. 30 were the alloy sheets having the thickness of 0.25 mm and were produced from tile hot-rolled sheets of alloys No. 1 through No. 21 by the treatment of annealing of hot-rolled sheet in the temperature rage of 910° to 990° C., cold-rolling, recrystallization annealing in the temperature range of 860° to 940° C. for 125sec., cold-rolling, recrystallization annealing in the temperature range of 860° to 940° C. for 125 sec., finish cold-rolling at the reduction ratio of 15%, and stress relief annealing at 530° C. for 30 sec.

Materials No. 22 and No. 26 were the alloy sheets having the thickness of 0.25 mm and were produced from the hot-rolled sheets of alloys No. 22 and No. 2 by the treatment of cold-rolling at the reduction ratio of 92.5%, recrystallization annealing at 850° C. for 1 min., finish cold-rolling at the reduction ratio of 15%, and stress relief annealing at 530° C. for 3 sec.

Material No. 24 was the alloy sheet having the thickness of 0.25 mm and was produced from the hot-rolled sheet of alloy No. 1 by the treatment of annealing of the hot-rolled sheet at 950° C., cold-rolling at the reduction ratio of 74%, recrystallization annealing at 950° C. for 180 sec., cold-rolling at the reduction ratio of 40%, recrystallization at 950° C. for 180 sec., finish cold-rolling at the reduction ratio of 15%, and stress relief annealing at 530° C. for 30 sec.

Material No. 25 was the alloy sheet having the thickness of 0.25 mm and was produced from the hot-rolled sheet of alloy No. 1 by the treatment of annealing of the hot-rolled sheet at 950° C., cold-rolling, recrystallization annealing at 800° C. for 30 sec., cold-rolling, recrystallization annealing at 800° C. for 30 sec., finish cold-rolling, and stress relief annealing at 530° C. for 30 sec.

Material No. 23 was the alloy sheet having the thickness of 0.25 mm and was produced from the hot-rolled sheet of alloy No. 23 by the treatment of annealing of the hot-rolled sheet at 970° C., cold-rolling, recrystallization annealing at 800° C. for 30 sec., cold-rolling, recrystallization annealing at 800° C. for 30 sec., finish cold-rolling, and stress relief annealing at 530° C. for 30 sec.

Materials No. 31 through No. 34 were the alloy sheets having the thickness of 0.25 mm and were produced from the hot-rolled sheets of alloys No. 3, No. 4, and No. 7 by the treatment of cold-rolling, recrystallization annealing in the temperature range of 860 to 940° C. for 125 sec., cold-rolling, recrystallization annealing in the temperature range of 860 to 940° C. for 125 sec., finish cold-rolling, and stress relief annealing at 530° C. for 30 sec.

All those produced hot-rolled sheets showed sufficient recrystallization after annealing.

Alloy sheets of material No. 1 through No. 12 and No. 15 through No. 34 prepared by the treatment described above were etched and formed into flat masks. The flat masks were treated by the annealing before press-forming at 770° C. for 45 min., followed by press-foraging. The press-formability was tested during the procedure. Partial color-phase shift was measured after blackening the press-formed shadow masks, assembling them into cathode ray tube, and irradiating electron beam on the surface thereof. Alloy sheets of material No. 13 and No. 14 were subjected to the annealing before press-forming at 795° C. for 3 min., which were then etched and formed into flat masks. Those flat masks were press-foraged to determine the press-formability. Those alloys were also checked for the partial color-phase shift using the same procedure as before.

Table 3 and Table 4 give the average austenite grain size, Dav, before the annealing before press-forming, the degree of austenite mixed grains, Dmax/Dmin, the Vickers hardness, Hv, [10×Dav+80–Hv] and [Hv–10×Dav–50]. Table 5 and Table 6 give the degree of each plane on the sheet surface before the annealing before press-forming, the press-formability, and the partial color-phase shift.

According to Table 3 through Table 6, materials No. 1 through No. 13 satisfied the conditions specified in the present invention, which conditions include the degree of planes, {111}, {100}, {110}, {311}, {331}, {210}, and {211}, the average austenite grain size, Dav, the degree of austenite mixed grain, Dmax/Dmin, the Vickers hardness, Hv, and the condition of [10×Dav+80≧Hv≧10×Dav+50]. All of those materials gave an excellent press-formability without giving partial color-phase shift. Materials No. 14 through No. 17 which contained Co and which are the examples of the present invention also showed excellent characteristics. Materials No. 13 and No. 14 were subjected to the annealing before press-forming before the etching, and they were found to have proper performance as the shadow mask even they were treated by the described production process.

On the contrary, materials No. 18 and No. 20 are comparative examples each containing the amount of Si and N larger than the specified level of the present invention, respectively, and they raised the problem of fitness to dies during press-forming step. Material No. 19 is a comparative example containing the amount of O larger than the specified level of the present invention, and it gave the average austenite grain size, Dav, before the annealing before press-forming less than 10.5 μm. Therefore, the material No. 19 gave a poor shape fixability at the press-forming, and generated cracks on the alloy sheet. Furthermore, the degree of austenite mixed grain of the material No. 19 exceeded the specified level of the present invention, so the blurred periphery of pierced holes also occurred.

Materials No. 21 and No. 22 are comparative examples including the amount of B above the specified range of the present invention, and both gave the average austenite grain size, Dav, less than 10.5 μm. Consequently, they were inferior in the shape fixability at press-forming and they induced cracks on the alloy sheets. In addition, their degree of austenite mixed grain also exceeded the specified range of the present invention so that the blurred periphery of pierced holes occurred. In particular, the material No. 22 was produced by cold-rolling at the reduction ratio of 92.5%, recrystallization annealing at 850° C. for 1min., and finish cold-rolling at the reduction ratio of 15% without applying the annealing of hot-rolled sheet, following the technology which was disclosed by the Japanese Unexamined Patent Publication No. 3-267320. The material No. 22 gave the degree of {110} plane and {100} plane outside of the range specified by the present invention. Particularly, the degree of austenite mixed grain became a high level.

Material No. 26 was prepared with the same procedure as applied to material No. 22, and the material No. 26 is a comparative example which gave the degree of {100} plane and {110} plane outside of the range specified by the present invention. The material No. 26 gave a large degree of austenite mixed grain so that the blurred periphery of pierced holes occurred. As described above, even if an alloy satisfies the composition condition of the present invention, it can not provide an excellent press-formability unless it satisfies the condition of the present invention on the degree of planes and the degree of austenite mixed grain.

Materials No. 24 and No. 25 were produced under the condition of recrystallization annealing after the cold-rolling, at 950° C. for 180 sec. and at 800° C. for 30 sec., respectively. Material No. 24 is a comparative example which gave the average austenite grain size, Dav, above the specified range of the present invention, and material No. 25 is a comparative example which gave the average austenite grain size, Dav, below the specified range of the present invention. Both materials were inferior in the shape fix ability.

Materials No. 31 through No. 34 were prepared employing the same processes after the cold-rolling step as in the case of No. 1 through No. 21 without using annealing of hot-rolled sheet. Among them, the material No. 31 is a Comparative example giving the degree of {110} plane outside of the specified range of the present invention, which material gave the degree of austenite mixed grain above the specified range of the present invention, and the blurred periphery of pierced holes occurred. Material No. 33 is a Comparative example giving the degree of {211} plane above the specified range of the present invention, which induced cracks on the alloy sheet. Material No. 32 is a Comparative example giving the degree of {111} plane and {311} plane outside of the specified range of the present invention. Material No. 34 is a Comparative example giving the degree of {311} plane and {210} plane above the specified range of the present invention. Those comparative examples induced partial color phase shift.

Materials No. 27, No. 28, No. 29, and No. 30 are Comparative examples giving Vickers hardness, Hv, above the specified range of the present invention, Vickers hardness, Hv, below the specified range of the present invention, $10\times Dav+80<Hv$, and $Hv<10\times Dav+50$, respectively. All of them showed poor shape fixability.

As described above, the Fe—Ni alloy sheet and Fe—Ni—Co alloy sheet for a shadow mask having excellent press-formability and screen quality being aimed by the present invention are obtained by satisfying the conditions of composition, degree of planes before the annealing before press-forming, average austenite grain size, Dav, degree of austenite mixed grain, Dmax/Dmin, Vickers hardness, Hv, and the condition of $10\times Dav+80\geqq Hv\geqq 10\times Dav+50$, which conditions are specified by the present invention.

As described above in detail, an Fe—Ni alloy sheet and an Fe—Ni—Co alloy sheet for a shadow mask of the present invention provide excellent press-formability even if they are subjected to the annealing before press-forming at a relatively low temperature, below 800° C. The excellent press-formability includes good shape fixability, good fitness to dies, and less occurrence of cracks on the alloy sheet during press-forming. Excellent screen quality is also secured without partial color-phase shift. Furthermore, the alloy sheet of the present invention provides a necessary etching performance and press-formability even when it is subjected to the annealing before press-forming before the etching. Therefore, a preliminary annealing on the alloy sheet eliminates the annealing before press-forming at the cathode ray tube manufacturer. This process optimization gives the users of alloy sheets a great economical advantage.

TABLE 1

| | Chemical composition (wt. % excluding H) | | | | | | | | | |
|---|---|---|---|---|---|---|---|---|---|---|
| Alloy No. | Ni | Si | O | N | B | C | Mn | Cr | H (ppm) | Co |
| 1 | 35.9 | 0.005 | 0.0010 | 0.0008 | 0.00005 | 0.0013 | 0.25 | 0.01 | 1.0 | — |
| 2 | 36.1 | 0.02 | 0.0013 | 0.0010 | 0.0001 | 0.0011 | 0.26 | 0.02 | 0.2 | — |
| 3 | 36.0 | 0.03 | 0.0014 | 0.0011 | 0.0001 | 0.0015 | 0.04 | 0.02 | 0.8 | 0.001 |
| 4 | 36.5 | 0.05 | 0.0020 | 0.0015 | 0.0005 | 0.0040 | 0.35 | 0.02 | 1.0 | 0.020 |
| 5 | 35.8 | 0.01 | 0.0015 | 0.0010 | 0.0002 | 0.0023 | 0.25 | 0.05 | 0.9 | — |
| 6 | 35.7 | 0.01 | 0.0012 | 0.0009 | 0.0001 | 0.0020 | 0.27 | 0.01 | 0.9 | 0.500 |
| 7 | 36.0 | 0.02 | 0.0008 | 0.0007 | 0.0002 | 0.0009 | 0.11 | 0.03 | 0.7 | — |
| 8 | 36.2 | 0.05 | 0.0005 | 0.0005 | 0.0001 | 0.0007 | 0.05 | 0.02 | 0.9 | 0.500 |
| 9 | 36.2 | 0.001 | 0.0002 | 0.0002 | 0.0001 | 0.0005 | 0.005 | 0.01 | 0.6 | 0.004 |
| 10 | 35.5 | 0.04 | 0.0018 | 0.0011 | 0.0001 | 0.0032 | 0.01 | 0.01 | 0.6 | — |

TABLE 1-continued

| Alloy No. | Chemical composition (wt. % excluding H) | | | | | | | | | |
|---|---|---|---|---|---|---|---|---|---|---|
| | Ni | Si | O | N | B | C | Mn | Cr | H (ppm) | Co |
| 11 | 35.8 | 0.03 | 0.0016 | 0.0012 | 0.0002 | 0.0030 | 0.20 | 0.02 | 0.3 | — |
| 12 | 35.0 | 0.05 | 0.0019 | 0.0015 | 0.0004 | 0.0039 | 0.15 | 0.03 | 0.2 | 0.750 |

TABLE 2

| Alloy No. | Chemical composition (wt. % excluding H) | | | | | | | | | |
|---|---|---|---|---|---|---|---|---|---|---|
| | Ni | Si | O | N | B | C | Mn | Cr | H (ppm) | Co |
| 13 | 36.0 | 0.01 | 0.0017 | 0.0012 | 0.0001 | 0.0037 | 0.05 | 0.04 | 0.5 | 0.050 |
| 14 | 31.9 | 0.05 | 0.0021 | 0.0015 | 0.0001 | 0.0018 | 0.13 | 0.02 | 0.4 | 5.300 |
| 15 | 31.0 | 0.03 | 0.0014 | 0.0019 | 0.0001 | 0.0020 | 0.30 | 0.04 | 0.7 | 5.953 |
| 16 | 30.0 | 0.02 | 0.0017 | 0.0016 | 0.0002 | 0.0023 | 0.24 | 0.04 | 0.8 | 4.101 |
| 17 | 29.5 | 0.01 | 0.0016 | 0.0008 | 0.0010 | 0.0045 | 0.35 | 0.03 | 0.8 | 6.521 |
| 18 | 35.6 | 0.08 | 0.0020 | 0.0014 | 0.0002 | 0.0021 | 0.28 | 0.03 | 1.1 | — |
| 19 | 36.2 | 0.05 | 0.0035 | 0.0012 | 0.0001 | 0.0017 | 0.31 | 0.04 | 1.1 | — |
| 20 | 36.3 | 0.04 | 0.0018 | 0.0020 | 0.0002 | 0.0019 | 0.25 | 0.03 | 1.3 | 0.020 |
| 21 | 36.0 | 0.04 | 0.0017 | 0.0015 | 0.0011 | 0.0025 | 0.28 | 0.04 | 1.2 | 0.010 |
| 22 | 35.8 | 0.05 | 0.0023 | 0.0016 | 0.0021 | 0.0032 | 0.27 | 0.04 | 1.3 | — |
| 23 | 34.2 | 0.02 | 0.0020 | 0.0007 | 0.0005 | 0.0017 | 0.31 | 0.05 | 0.8 | 2.534 |

TABLE 3

| Material No. | Alloy No. | Average grain size Dav (μm) | Dmax/ Dmin | Vickers hardness before annealing before press-forming (Hv) | 10 × Dav + 80 − Hv | Hv − 10 × Dav − 50 | Type of example |
|---|---|---|---|---|---|---|---|
| 1 | 1 | 11.8 | 5.0 | 181 | Positive | Positive | Present invention |
| 2 | 2 | 11.7 | 15.0 | 180 | Positive | Positive | Present invention |
| 3 | 3 | 11.8 | 6.5 | 175 | Positive | Positive | Present invention |
| 4 | 4 | 12.6 | 12.5 | 206 | O | Positive | Present invention |
| 5 | 5 | 12.5 | 8.0 | 175 | Positive | Positive | Present invention |
| 6 | 6 | 12.5 | 11.0 | 190 | Positive | Positive | Present invention |
| 7 | 7 | 11.1 | 5.4 | 191 | O | Positive | Present invention |
| 8 | 8 | 13.7 | 15.0 | 188 | Positive | Positive | Present invention |
| 9 | 9 | 11.5 | 12.0 | 166 | Positive | Positive | Present invention |
| 10 | 10 | 10.5 | 9.0 | 185 | O | Positive | Present invention |
| 11 | 11 | 10.6 | 10.1 | 165 | Positive | Positive | Present invention |
| 12 | 12 | 14.0 | 11.8 | 219 | Positive | Positive | Present invention |
| 13 | 13 | 15.0 | 9.8 | 220 | Positive | Positive | Present invention |
| 14 | 14 | 12.5 | 5.5 | 179 | Positive | Positive | Present invention |
| 15 | 15 | 12.7 | 7.0 | 180 | Positive | Positive | Present invention |
| 16 | 16 | 12.4 | 6.2 | 175 | Positive | Positive | Present invention |
| 17 | 17 | 13.0 | 6.8 | 200 | Positive | Positive | Present invention |

TABLE 4

| Material No. | Alloy No. | Average grain size Dav (μm) | Dmax/ Dmin | Vickers hardness before annealing before press-forming (Hv) | 10 × Dav + 80 − Hv | Hv − 10 × Dav − 50 | Type of example |
|---|---|---|---|---|---|---|---|
| 18 | 18 | 10.6 | 14.0 | 185 | Positive | Positive | Comparative example |
| 19 | 19 | 8.5 | 19.5 | 175 | Negative | Positive | Comparative example |
| 20 | 20 | 10.5 | 15.0 | 173 | Positive | Positive | Comparative example |
| 21 | 21 | 9.0 | 18.5 | 180 | Negative | Positive | Comparative example |
| 22 | 22 | 10.0 | 20.0 | 183 | Negative | O | Comparative example |
| 23 | 23 | 10.0 | 10.0 | 160 | Positive | Positive | Comparative example |

TABLE 4-continued

| Material No. | Alloy No. | Average grain size Dav (μm) | Dmax/ Dmin | Vickers hardness before annealing before press-forming (Hv) | 10 × Dav + 80 − Hv | Hv − 10 × Dav − 50 | Type of example |
|---|---|---|---|---|---|---|---|
| 24 | 1 | 15.5 | 14.0 | 205 | Positive | Positive | Comparative example |
| 25 | 1 | 9.5 | 14.5 | 170 | Positive | Positive | Comparative example |
| 26 | 2 | 10.5 | 22.0 | 180 | Positive | Positive | Comparative example |
| 27 | 5 | 11.0 | 14.0 | 225 | Negative | Positive | Comparative example |
| 28 | 2 | 10.8 | 13.5 | 163 | Positive | Positive | Comparative example |
| 29 | 6 | 11.9 | 15.0 | 200 | Negative | Positive | Comparative example |
| 30 | 6 | 13.3 | 12.0 | 175 | Positive | Negative | Comparative example |
| 31 | 4 | 10.9 | 16.7 | 170 | Positive | Positive | Comparative example |
| 32 | 3 | 11.5 | 6.0 | 185 | Positive | Positive | Comparative example |
| 33 | 4 | 10.8 | 6.0 | 167 | Positive | Positive | Comparative example |
| 34 | 7 | 11.2 | 13.0 | 190 | Positive | Positive | Comparative example |

TABLE 5

| Material No. | Alloy No. | Gathering degree of crystal plane before annealing before press-forming (%) | | | | | | | Press-formability | | | | | Type of example |
|---|---|---|---|---|---|---|---|---|---|---|---|---|---|---|
| | | {111} | {100} | {110} | {311} | {331} | {210} | {211} | Shape fix ability | Fitnes to die | Cracking on the alloy sheet | Blurred periphery of pierced hole | Partial color phase shift | |
| 1 | 1 | 9 | 16 | 24 | 14 | 12 | 13 | 12 | ⊙ | ○ | None | ⊙ | None | Present invention |
| 2 | 2 | 2 | 72 | 8 | 3 | 8 | 4 | 3 | ⊙ | ○ | None | ○ | None | Present invention |
| 3 | 3 | 6 | 27 | 30 | 11 | 7 | 11 | 8 | ⊙ | ○ | None | ⊙ | None | Present invention |
| 4 | 4 | 3 | 62 | 15 | 6 | 8 | 4 | 2 | ○ | ○ | None | ○ | None | Present invention |
| 5 | 5 | 7 | 36 | 23 | 12 | 8 | 10 | 4 | ○ | ○ | None | ⊙ | None | Present invention |
| 6 | 6 | 6 | 51 | 17 | 7 | 9 | 5 | 5 | ⊙ | ○ | None | ○ | None | Present invention |
| 7 | 7 | 10 | 21 | 29 | 10 | 10 | 10 | 10 | ○ | ○ | None | ⊙ | None | Present invention |
| 8 | 8 | 4 | 5 | 37 | 17 | 12 | 13 | 12 | ○ | ○ | None | ○ | None | Present invention |
| 9 | 9 | 4 | 55 | 15 | 7 | 8 | 6 | 5 | ○ | ○ | None | ○ | None | Present invention |
| 10 | 10 | 6 | 41 | 22 | 9 | 10 | 7 | 5 | ○ | ○ | None | ⊙ | None | Present invention |
| 11 | 11 | 10 | 8 | 31 | 15 | 11 | 12 | 13 | ○ | ○ | None | ⊙ | None | Present invention |
| 12 | 12 | 9 | 7 | 35 | 16 | 12 | 10 | 11 | ○ | ○ | None | ○ | None | Present invention |
| 13 | 13 | 7 | 45 | 18 | 8 | 9 | 6 | 5 | ○ | ○ | None | ⊙ | None | Present invention |
| 14 | 14 | 9 | 22 | 30 | 10 | 9 | 9 | 11 | ⊙ | ○ | None | ⊙ | None | Present invention |
| 15 | 15 | 8 | 28 | 25 | 9 | 10 | 10 | 10 | ⊙ | ○ | None | ⊙ | None | Present invention |
| 16 | 16 | 7 | 23 | 32 | 12 | 9 | 8 | 9 | ⊙ | ○ | None | ⊙ | None | Present invention |
| 17 | 17 | 5 | 31 | 35 | 7 | 8 | 8 | 6 | ⊙ | ○ | None | ⊙ | None | Present invention |

TABLE 6

| Material No. | Alloy No. | Gathering degree of crystal plane before annealing before press-forming (%) {111} | {100} | {110} | {311} | {331} | {210} | {211} | Press-formability: Shape fix ability | Fitnes to die | Cracking on the alloy sheet | Blurred periphery of pierced hole | Partial color phase shift | Type of example |
|---|---|---|---|---|---|---|---|---|---|---|---|---|---|---|
| 18 | 18 | 2 | 65 | 12 | 6 | 8 | 5 | 2 | o | x | None | o | None | Comparative example |
| 19 | 19 | 2 | 90 | 3 | 1 | 2 | 1 | 1 | x | o | Yes | x | Impossible to evaluate | Comparative example |
| 20 | 20 | 3 | 73 | 6 | 4 | 7 | 4 | 3 | o | x | None | o | None | Comparative example |
| 21 | 21 | 2 | 85 | 4 | 2 | 4 | 2 | 1 | x | o | Yes | x | Impossible to evaluate | Comparative example |
| 22 | 22 | 1 | 93 | 0 | 1 | 3 | 1 | 1 | x | o | Yes | x | Impossible to evaluate | Comparative example |
| 23 | 23 | 9 | 45 | 25 | 8 | 4 | 5 | 4 | x | o | Yes | ⊚ | Impossible to evaluate | Comparative example |
| 24 | 1 | 3 | 70 | 10 | 2 | 9 | 4 | 2 | x | o | None | o | Impossible to evaluate | Comparative example |
| 25 | 1 | 3 | 73 | 6 | 3 | 7 | 4 | 4 | x | o | None | o | Impossible to evaluate | Comparative example |
| 26 | 2 | 0 | 97 | 3 | 0 | 0 | 0 | 0 | o | o | None | x | Impossible to evaluate | Comparative example |
| 27 | 5 | 2 | 71 | 9 | 4 | 7 | 5 | 2 | x | o | None | o | Impossible to evaluate | Comparative example |
| 28 | 2 | 1 | 65 | 10 | 7 | 9 | 7 | 1 | x | o | None | o | Impossible to evaluate | Comparative example |
| 29 | 6 | 12 | 5 | 40 | 10 | 11 | 11 | 11 | x | o | None | o | Impossible to evaluate | Comparative example |
| 30 | 6 | 11 | 7 | 37 | 13 | 9 | 10 | 13 | x | o | None | o | Impossible to evaluate | Comparative example |
| 31 | 4 | 13 | 3 | 45 | 9 | 9 | 11 | 10 | o | o | None | Δ | Impossible to evaluate | Comparative example |
| 32 | 3 | 16 | 15 | 7 | 22 | 15 | 13 | 12 | o | o | None | o | Yes | Comparative example |
| 33 | 4 | 8 | 24 | 32 | 4 | 3 | 3 | 26 | o | o | Yes | o | None | Comparative example |
| 34 | 7 | 14 | 6 | 15 | 11 | 21 | 23 | 10 | o | o | None | o | Yes | Comparative example |

Preferred Embodiment 2

An alloy sheet consisting essentially of Fe, Ni, Cr, Si, B, O, N, and Sb, and an alloy sheet consisting essentially of Fe, Ni, Cr, Co, Si, B, O, N, and Sb of the present invention are described in the following.

The reason why the composition of the present invention is limited is described below.

A Fe—Ni alloy sheet for shadow mask is requested to have the upper limit of average thermal expansion coefficient of $3.0\times(1/10^6)/°$ C. in the temperature range of 30° to 100° C. for the prevention of color-phase shift. The thermal expansion coefficient depends on the Ni content of the alloy, and the Ni content which satisfies the above specified upper limit of the average thermal expansion coefficient is in a range of from 34 to 38 wt. %. Accordingly, the Ni content is specified as 34 to 38 wt. %. For further low average thermal expansion coefficient, the Ni content is preferably adjusted to 35 to 37 wt. %, and most preferably to 35.5 to 36.5 wt. %. In ordinary cases, Fe—Ni alloys contain Co to some extent as an inevitable impurity, and the Co content of 1 wt. % or less affects very little on the characteristics of alloy while the above specified range of Ni content is acceptable.

However, a Fe—Ni alloy which contains Co over 1 wt. % to 7 wt. % needs to limit the Ni content to be in a range from 28 to 38 wt. % for satisfying the above described condition of average thermal expansion coefficient. Therefore, if the Co content is over 1 wt. % to 7 wt. %, then the Ni content is specified to be in a range of from 28 to 38 wt. %. By adjusting the Co content to be in a range of 3 to 6 wt. % and the Ni content to a range of from 30 to 33 wt. %, a superior characteristic giving a lower average thermal expansion coefficient is obtained. If the Co content exceeds 7 wt. %, the thermal expansion coefficient degrades, so the upper limit of Co content is specified as 7 wt. %.

Chromium improves the corrosion resistance of alloy, but degrades (increase) the thermal expansion coefficient. When the alloy is adjusted to have a gathering degree of planes, grain size, and hardness to satisfy the condition of the present invention, which condition is described below, an effect of improving corrosion resistance is obtained when the alloy has a Co content of 0.01 wt. % or more. On the other hand, when the Cr content exceeds 3 wt. %, the alloy can not provide the average thermal expansion coefficient specified by the present invention. Chromium content of less than 0.01% gives no effect of improvement in corrosion resistance. Therefore, the upper limit and the lower limit of Cr content are specified as 3.0 wt. % and 0.01 wt. %, respectively.

Oxygen is one of the inevitable impurities. Increased content of O increases the non-metallic oxide inclusion in the alloy, which inclusion suppresses the growth of crystal grains during the annealing before press-forming. Particularly at the temperature less than 800° C., the O inclusion suppresses the grain growth. If the content of O exceeds 0.004 wt. %, the growth of grains is significantly interfered, and the press-forming quality being aimed by the present invention can not be obtained. In this respect, the present invention specifies the upper limit of O content as 0.004 wt. %. The lower limit of O content is not specifically limited, but it is substantially selected as 0.0001 wt. % from the economy of ingot-making process.

B improves the hot-working performance of the alloy. Excess amount of B, however, induces the segregation of B at boundary of recrystallized grains formed during annealing before press-forming, which inhibits the tree migration of grain boundaries and results in the suppression of grain growth and the dissatisfaction of necessary 0.2 wt. % proof stress after the annealing before press-forming. In particular, under the annealing before press-forming at a relatively low temperature, which is specified in the present invention, the suppression against the grain growth is strong and the action does not uniformly affects on all grains. As a result, a severe mixed grain structure appears accompanied with irregular elongation of material during press-forming, which induces blurred periphery of pierced hole on shadow mask. Boron content above 0.005 wt. % significantly enhances the suppression of grain growth, and the press-formability being aimed in the present invention can not be obtained. Also the problem of blurred periphery of pierced holes arises. Consequently, the present invention specifies the upper limit of the B content as 0.005 wt. %. From the above described viewpoint, more preferably the B content is 0.001 wt. % or less.

Silicon is added as the deoxidizer element during ingot-making of the alloy. When the Si content exceeds 0.2 wt. %, an oxide film of Si is formed on the surface of alloy at the annealing before press-forming. The oxide film degrades the fitness with dies during press-forming and results in the galling of dies by alloy sheet. Consequently, the upper limit of Si content is specified as 0.2 wt. %. Further reduction of Si content improves the fitness of dies and alloy sheet. The lower limit of Si content is not necessarily specified but approximately 0.001 wt. % is the virtual lower limit from the economy of ingot-making process.

Nitrogen is an element that unavoidably enters into the alloy during ingot-making process. Nitrogen content of 0.003 wt. % or more induces the concentration of N on the surface of the alloy during the annealing before press-forming and yields nitride. The nitride degrades the fitness of alloy with dies during the press-forming process and induces galling of dies by alloy sheet. Consequently, the N content is specified as 0.003 wt. % or less. Although the lower limit of N content is not necessarily defined, approximately 0.0001 wt. % is the virtual lower limit from the economy of ingot-making process.

Antimony is an element of unavoidable inclusion, and the Sb content more than 0.05 wt. % interferes with the growth of the alloy grains of the present invention, which inhibits the ability to obtain a grain size being aimed in the present invention. Consequently, the upper limit of Sb content is specified as 0.05 wt. %. Regarding the elements other than above described, the preferable range of C is 0.0001 to 0.010 wt. % and that of Mn is 0.001 to 0.5 wt. %.

According to the present invention, to improve the shape fixability, to suppress crack generation on alloy sheet surface during press-forming, and to prevent generation of blurred periphery of pierced holes of the prepared shadow mask, it is necessary to define, in addition to the composition above specified, the specific range for each of the average austenite grain size, Dav, before the annealing before press-forming, the ratio of maximum size to minimum size of austenite grains, Dmax/Dmin, and the Vickers hardness, Hv, and furthermore it is necessary to limit the relation between the Vickers hardness, Hv, and the average austenite grain size, Dav, to satisfy a specific correlation.

Figure 4:
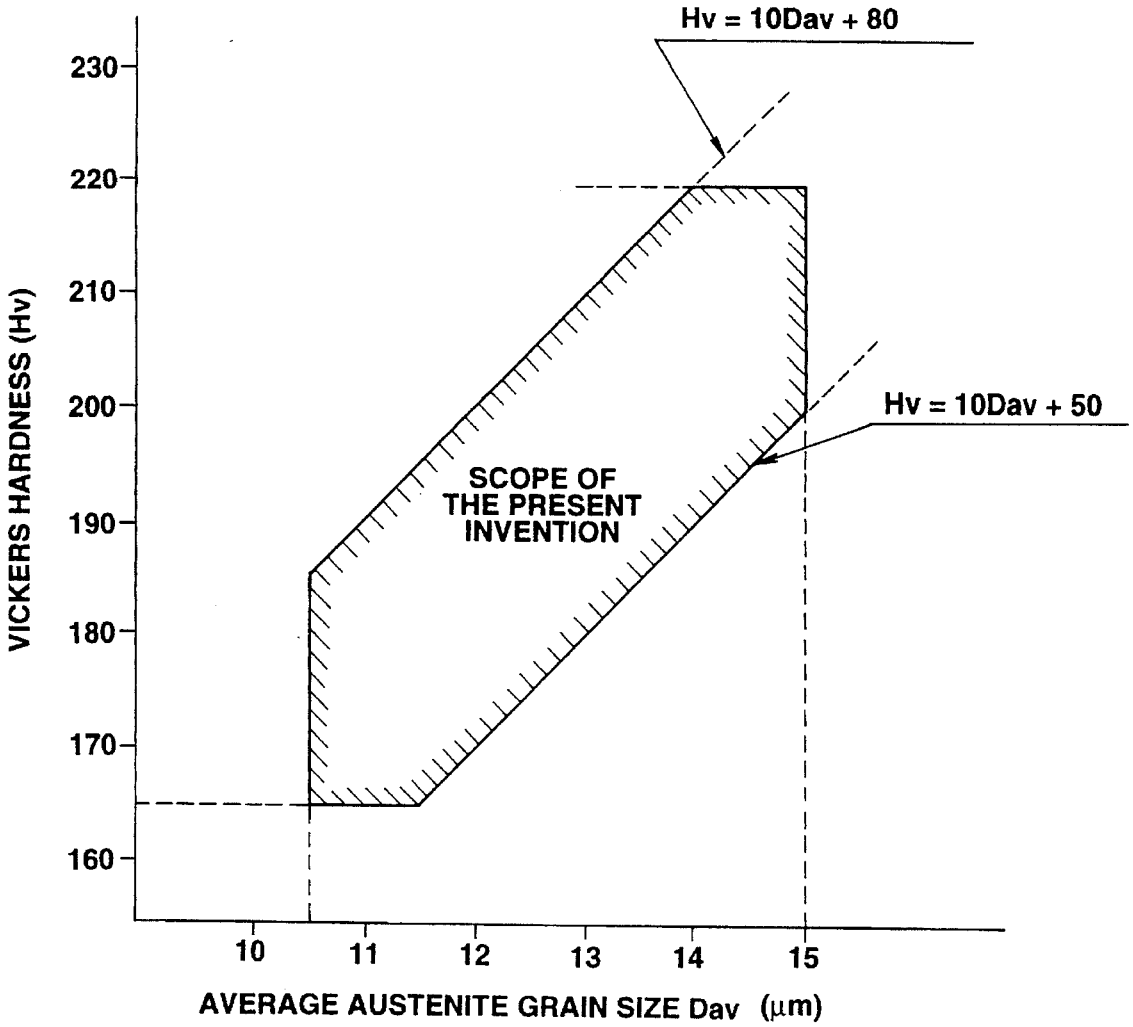
FIG. 4 is a graph showing effect of an average austenite grain size and Vickers hardness on a press-formability according to the preferred embodiment 2.

FIG. 4 shows the effect of average austenite grain size, Dav, and Vickers hardness, Hv, before the annealing before press-forming on the press-formability. In that case, the alloy sheet had the composition specified in the present invention and had the values of the ratio of the maximum size to the minimum size of austenite grains, Dmax/Dmin, before annealing before press-forming and of the degree of each plane in the range specified in the present invention, and the alloy sheet was subjected to the annealing before press-forming at a temperature below 800° C. followed by the press-forming. According to FIG. 4, the value of Dav below 10.5 μm can not enhance the growth of grain in alloy sheet during the annealing before press-forming under the temperature condition being aimed by the present invention, below 800° C., and increases spring back and results in a poor shape fixability because of the insufficient growth of grains. On the other hand, the value of Dav above 15.0 μm hinders the recrystallization during the annealing before press-forming and results in a poor shape fixability owing to the insufficient recrystallization.

Vickers hardness, Hv, is mainly determined by the reduction ratio of cold-rolling. The value of Hv below 165 can not give sufficient strain to the alloy sheet, and gives only a weak driving force for recrystallization during the annealing before press-forming. The result is insufficient recrystallization, which leaves the alloy sheet at a rather rigid state even after the annealing before press-forming. As a result, the shape fixability is poor. On the other hand, when excess strain is given to the alloy sheet to induce Hv above 220, the driving force for recrystallization during the annealing before press-forming becomes strong, which yields excess frequency of nuclei formation during recrystallization. Consequently, the grains become fine after the annealing before press-forming to degrade the shape fix ability.

FIG. 4 also indicates that an adequate recrystallization during the annealing before press-forming is realized by keeping the relation between Vickers hardness, Hv, and average austenite grain size Dav. A large average austenite grain size, Dav, before the annealing before press-forming requires a large degree of strain for obtaining a sufficient driving force during the annealing before press-forming step. Accordingly, the lower limit of the Vickers hardness, Hv, is necessary to be defined depending on the corresponding average austenite grain size, Dav. On the other hand, since a smaller average austenite grain size, Dav, has results in a larger number of nucleation sites, the upper limit of Vickers hardness, Hv, is necessary to be defined depending on the corresponding average austenite grain size, Dav, to prevent the generation of fine grains after the annealing before press-forming. According to FIG. 4, even the Vickers hardness, Hv, is 165 or more, if the equation of [$Hv<10\times Dav+50$] is satisfied, then the driving force for the recrystallization during the annealing before press-forming is relatively too small, and sufficient recrystallization can not be obtained. Therefore, the material remains rigid even after the annealing before press-forming and is poor in the shape fixability. Even when the Vickers hardness, Hv, is 220 or less value, if the equation of [$Hv>10\times Dav+80$] is satisfied, then the driving force for the recrystallization during the annealing before press-forming is relatively too large, and the grains become fine after the annealing before press-forming and shape fixability is poor.

Figure 5:
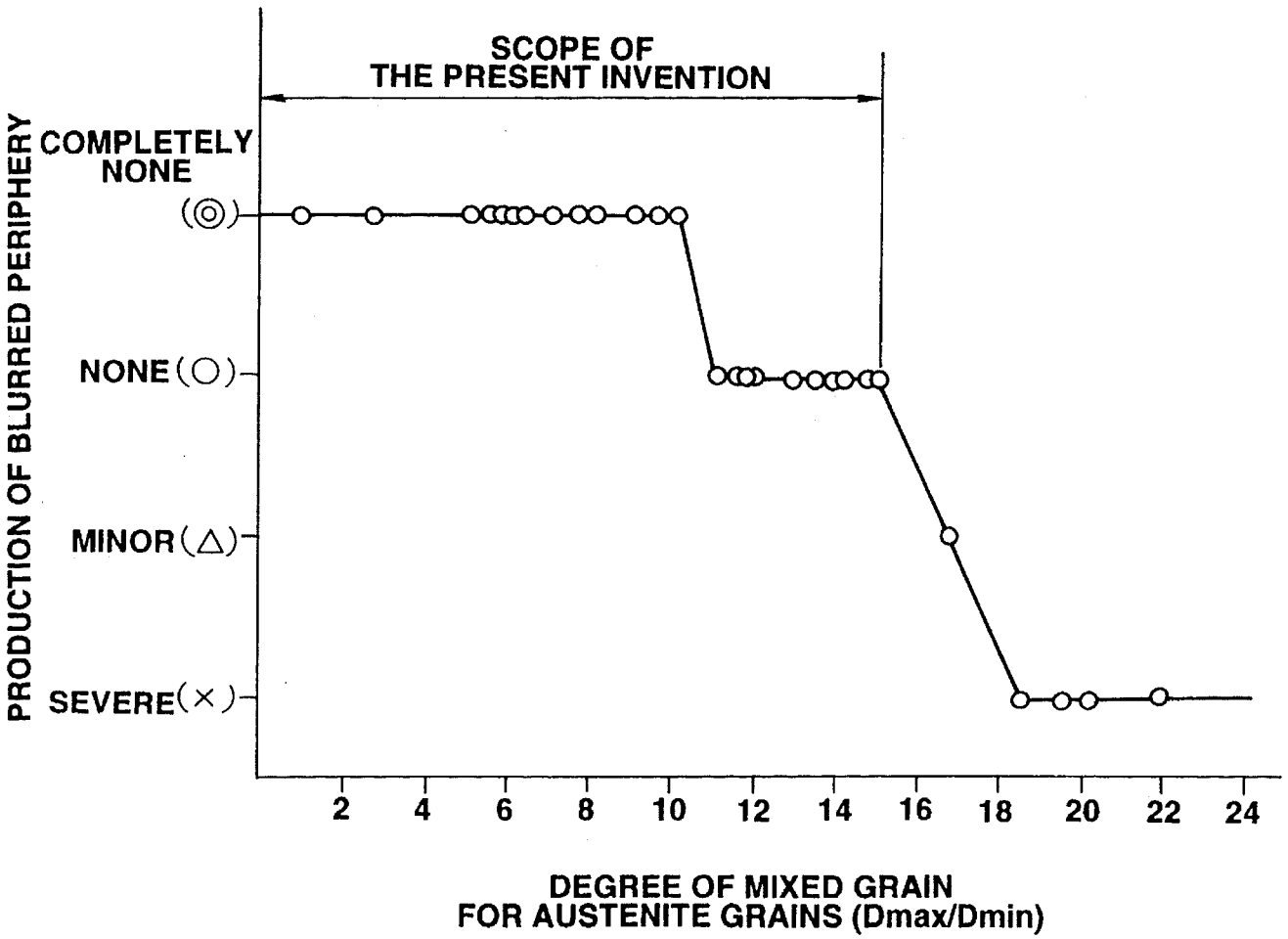
FIG. 5 is a graph showing a relation between a degree of mixed grain for austenite grains, and production of a blurred periphery of pierced holes according to the preferred embodiment 2.

FIG. 5 shows the effect of the ratio of the maximum size to the minimum size of austenite grains, Dmax/Dmin, before the annealing before press-forming on the blurred periphery of pierced holes of a prepared shadow mask. In that case, the alloy sheet had the composition specified in the present invention and had the values of the average austenite grain size, Dav, before annealing before press-forming, the Vickers hardness, Hv, and the degree of each plane with the range specified in the present invention, and the alloy sheet was subjected to the annealing before press-forming at a temperature less than 800° C. followed by the press-forming. According to FIG. 5, when the ratio of the maximum size to the minimum size of austenite grains, Dmax/Dmin, exceeds 15, the etched hole size becomes irregular and induces blurred periphery of pierced hole. The smaller Dmax/Dmin value is more favorable, and the lower limit of the Dmax/Dmin is specified as 1.

From the consideration given above, the present invention specifies the average austenite grain size, Dav, before the annealing before press-forming as in a range of from 10.5 to 15.0 μm, the ratio of the maximum size to the minimum size of the austenite grains, Dmax/Dmin, (which ratio is hereinafter referred to simply as "degree of austenite mixed grain"), as in a range of from 1 to 15, and the Vickers hardness, Hv, as in a range of from 165 to 220, and also specifies the following equation:

$$10\times Dav+80 \geqq Hv \geqq 10\times Dav+50$$

for enhancing the growth of grains during the annealing before press-forming, for improving the shape fixability, and for suppressing the blurred periphery of pierced holes of a prepared shadow mask.

For the prevention of crack generation during the press-forming and for the prevention of blurred periphery of pierced holes and a partial color-phase shift on the prepared shadow mask, which are the objects of the present invention, it is important to limit the degree of planes on the alloy sheet surface before annealing before press-forming, as well as the limitations specified above.

The inventors found that the control of the degree of {211} plane on the alloy sheet surface before annealing before press-forming effectively suppresses the crack generation during press-forming and that the control of the degree of {100} plane and {110} plane suppresses the blurred periphery of pierced hole on the prepared shadow mask and that the control of the degree of {111} plane, {311} plane, {331} plane, and {210} plane suppresses the partial color-phase shift on the prepared shadow mask.

In concrete terms, when the degree of {211} plane exceeds 20%, the alloy sheet generates cracks during press-forming.

When the degree of{111} plane, {311} plane, {331} plane, and {210} plane exceeds 14%, 20%, 20%, and 20%, respectively, the etched hole shape abnormally deforms during press-forming, which induces a partial color-phase shift.

The control of the degree of {100} plane and {110} plane is necessary for limiting the degree of austenite mixed grain, Dmax/Dmin, within the range specified in the present invention. When the degree of {100} plane exceeds 75% or when the degree of {110} plane exceeds 40%, the degree of austenite mixed grain exceeds 15. In that case, the recrystallization during the annealing before press-forming does not proceed uniformly, and the grains after the annealing before press-forming become a mixed grain state inducing blurred periphery of pierced holes on the prepared shadow mask. When the degree of {100} plane is less than 5%, the degree of {110} plane exceeds 40%. When the degree of {110} plane is less than 5%, the degree of {100} plane exceeds 75%. In both cases, the degree of austenite mixed grain, Dmax/Dmin, exceeds 15 and induces blurred periphery of pierced hole on the prepared shadow mask.

Figure 6:
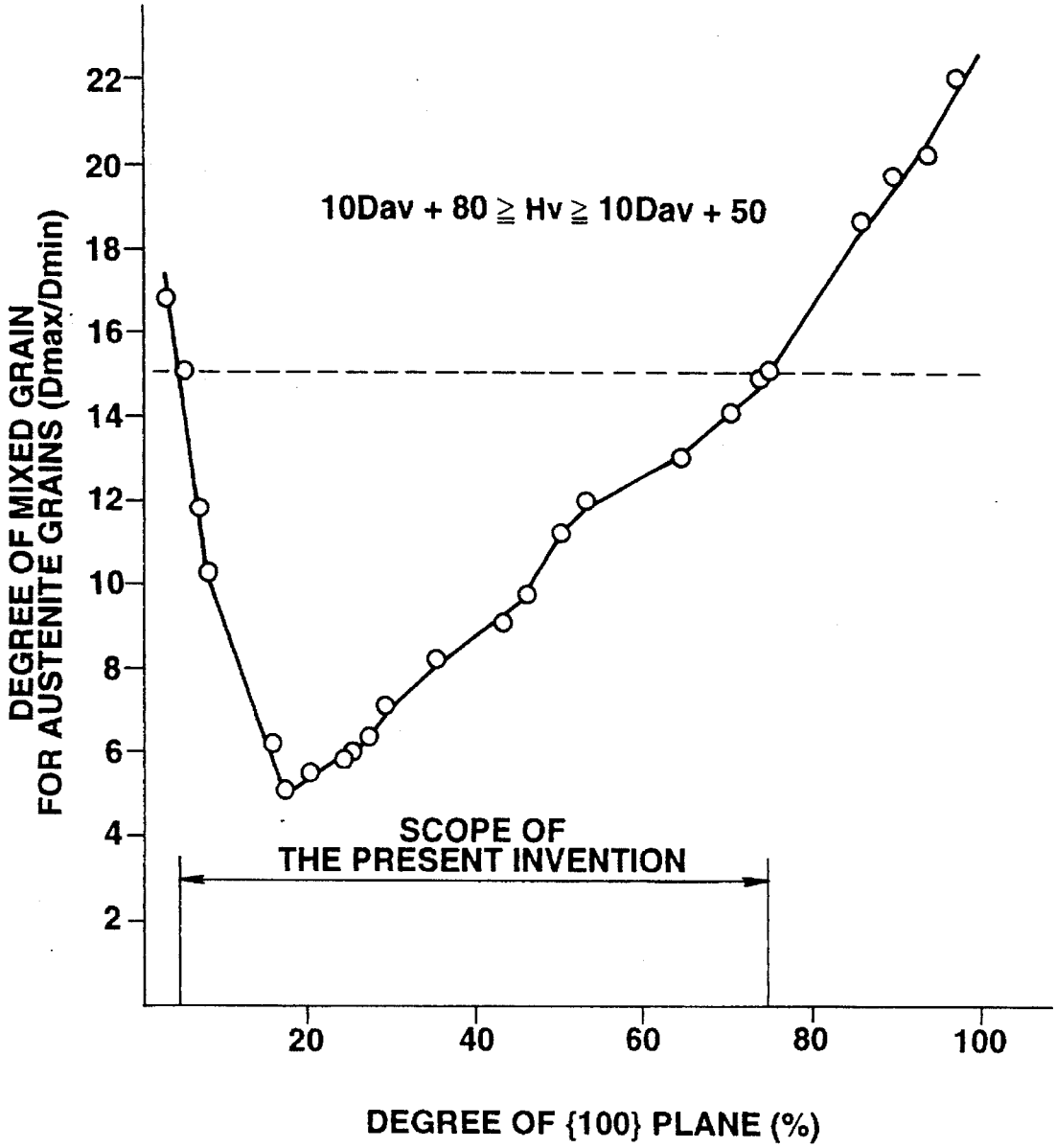
FIG. 6 is a graph showing a relation between a gathering degree of the {100} plane and a degree of mixed grain for austenite grains according to the preferred embodiment 2.

FIG. 6 shows the relation between the degree of {100} plane and the degree of austenite mixed grain, Dmax/Dmin. According to FIG. 6, the degree of austenite mixed grain can be controlled within a range of 1 to 15 by controlling the degree of {100} plane within a range of 5 to 75%. The degree of mixed grain is further reduced by controlling the degree of {100} plane wi a further limited range of 8 to 46% for more effective suppression of blurred periphery of pierced hole.

From the consideration given above, the present invention specifies the degree of each plane on the alloy sheet before annealing before press-foraging as listed below:

Degree of {111} plane: 14% or less

Degree of {100} plane: 5 to 75%

Degree of {110} plane: 5 to 40%

Degree of {311} plane: 20% or less

Degree of {331} plane: 20% or less

Degree of {210} plane: 20% or less

Degree of {211} plane: 20% or less

The value of the degree given above is the relative rate of each plane to the total degree of planes, {111}, {100}, {110}, {311}, {331}, {210}, and {211}.

The degree of each plane is determined from the degree of each plane divided by the sum of the degree of planes, {111}, {100}, {110}, {311}, {331}, {210}, and {211}, and expressed by percentage.

The degree of each plane, {111}, {100}, {110}, {311}, {331}, {210}, and {211}, before the annealing before press-forming, which is specified by the present invention, is normally obtained by selecting adequate condition of treatment after the hot-rolling step.

For example, when an alloy sheet of the present invention is produced by hot-rolling a slab which was prepared by slabbing or continuous casting followed by a sequence of annealing of hot-rolled sheet, primary cold-rolling, recrystallization annealing, secondary cold-rolling, recrystallization annealing, finish cold rolling, and stress relief annealing, an effective condition to obtain the degree of plane defined above is the control of the annealing temperature during the annealing of hot-rolled sheet step at an adequate level in a range of from 910° to 990° C. and furthermore the selection of optimum conditions of cold-rolling, recrystallization annealing, finish cold-rolling, and stress relief annealing.

To obtain the degree of planes specified by the present invention, the uniform heat treatment of a slab after blooming or after continuous casting is not preferable. For instance, when the uniform heat treatment is carried out at 1200° C. or higher temperature and for 10 hours or longer period, the degree of one or more of the planes {111}, {100}, {110}, {311}, {331}, {210}, and {211} does not satisfy the specification of the present invention. Therefore, such a uniform heat treatment should be avoided.

Other means may be employed to satisfy the degree of planes specified by the present invention. Quenching to solidify and texture controlling through the control of recrystallization during hot working are some of the examples of applicable means.

The alloy sheet of the present invention may be subjected to the annealing before press-foraging before the photo-etching step. If the annealing before press-forming is performed at a relatively low temperature which is a condition of the present invention, the quality of photo-etching is not degraded. In a conventional material, if the photo-etching is applied after the annealing before press-forming at a relatively low temperature specified by the present invention, the quality of the photo-etching is degraded, so the annealing before press-forming is virtually not applicable before the photo-etching. On the contrary, the materials of the present invention accept the photo-etching after the annealing before press-foraging without degrading the etching performance.

EXAMPLE 2

The inventors prepared the alloys of No. 1 through No. 23 having the composition listed on Table 7 by ladle refining. The alloys No. 1 through No. 13 were further treated by continuous casting to obtain the continuous cast slabs, and the alloys No. 18 through No. 23 were treated by molding to obtain ingots, which ingots were then treated by adjusting and slabbing to prepare the slabs. Those slabs were subjected to a surface treatment and were charged into a furnace to be heated at 1100° C. for 3 hours followed by hot-rolling to obtain the hot-rolled sheets.

Alloys No. 14 through No. 17 were cast directly into cast sheets which were then hot-rolled in the temperature range of 1000° to 1300° C. at the reduction ratio of 30% and were coiled at 750° C. to obtain the hot-rolled sheets.

TABLE 7

| Alloy | Chemical composition 1) | | | | | | | | | | |
|---|---|---|---|---|---|---|---|---|---|---|---|
| No. | Ni | Si | O | N | B | C | Mn | Cr | H (ppm) | Co | Sb |
| 1 | 35.8 | 0.005 | 0.0020 | 0.0008 | 0.00005 | 0.0012 | 0.27 | 0.01 | 1.1 | — | 0.01 |
| 2 | 36.2 | 0.04 | 0.0018 | 0.0012 | 0.0001 | 0.0011 | 0.25 | 0.03 | 0.2 | — | 0.02 |
| 3 | 36.4 | 0.03 | 0.0015 | 0.0014 | 0.0001 | 0.0017 | 0.05 | 0.50 | 0.9 | 0.001 | 0.02 |
| 4 | 36.6 | 0.05 | 0.0022 | 0.0015 | 0.0005 | 0.0040 | 0.35 | 0.02 | 1.0 | 0.023 | 0.01 |
| 5 | 35.5 | 0.01 | 0.0019 | 0.0010 | 0.0002 | 0.0024 | 0.28 | 1.02 | 1.0 | — | 0.01 |
| 6 | 35.6 | 0.02 | 0.0014 | 0.0008 | 0.0001 | 0.0020 | 0.27 | 1.50 | 0.9 | 0.505 | 0.02 |
| 7 | 36.0 | 0.02 | 0.0009 | 0.0007 | 0.0002 | 0.0010 | 0.12 | 0.03 | 0.7 | — | 0.02 |
| 8 | 36.2 | 0.05 | 0.0006 | 0.0006 | 0.0001 | 0.0006 | 0.05 | 0.03 | 0.8 | 0.500 | 0.01 |
| 9 | 36.0 | 0.001 | 0.0001 | 0.0002 | 0.0001 | 0.0005 | 0.005 | 0.04 | 0.6 | 0.005 | 0.005 |
| 10 | 35.6 | 0.01 | 0.0017 | 0.0014 | 0.0001 | 0.0032 | 0.02 | 2.00 | 0.7 | — | 0.01 |
| 11 | 35.7 | 0.07 | 0.0016 | 0.0012 | 0.0002 | 0.0030 | 0.22 | 0.07 | 0.3 | — | 0.02 |
| 12 | 35.2 | 0.06 | 0.0018 | 0.0016 | 0.0004 | 0.0049 | 0.17 | 0.03 | 0.5 | 0.751 | 0.02 |
| 13 | 36.0 | 0.01 | 0.0016 | 0.0018 | 0.0001 | 0.0037 | 0.08 | 0.05 | 0.8 | 0.050 | 0.02 |
| 14 | 31.8 | 0.15 | 0.0024 | 0.0014 | 0.0001 | 0.0088 | 0.50 | 2.80 | 0.4 | 5.320 | 0.02 |
| 15 | 31.1 | 0.18 | 0.0024 | 0.0019 | 0.0001 | 0.0020 | 0.32 | 0.04 | 0.8 | 5.950 | 0.03 |
| 16 | 30.2 | 0.17 | 0.0037 | 0.0017 | 0.0002 | 0.0021 | 0.40 | 0.06 | 0.8 | 4.100 | 0.04 |
| 17 | 29.6 | 0.01 | 0.0016 | 0.0020 | 0.0010 | 0.0055 | 0.50 | 2.95 | 0.9 | 6.520 | 0.05 |
| 18 | 35.7 | 0.21 | 0.0022 | 0.0016 | 0.0005 | 0.0024 | 0.28 | 0.03 | 1.1 | — | 0.02 |
| 19 | 36.2 | 0.05 | 0.0045 | 0.0013 | 0.0001 | 0.0027 | 0.32 | 0.04 | 1.1 | — | 0.02 |
| 20 | 36.1 | 0.03 | 0.0018 | 0.0035 | 0.0002 | 0.0019 | 0.28 | <0.01 | 1.3 | 0.020 | 0.02 |
| 21 | 36.1 | 0.02 | 0.0018 | 0.0015 | 0.0055 | 0.0025 | 0.30 | 0.05 | 1.2 | 0.012 | 0.02 |
| 22 | 35.8 | 0.09 | 0.0028 | 0.0016 | 0.0021 | 0.0042 | 0.28 | 0.04 | 1.3 | — | 0.03 |
| 23 | 34.1 | 0.08 | 0.0023 | 0.0008 | 0.0005 | 0.0027 | 0.32 | 0.06 | 0.9 | 2.530 | 0.06 |

TABLE 7-continued

| Alloy | Chemical composition 1) | | | | | | | | | | |
|---|---|---|---|---|---|---|---|---|---|---|---|
| No. | Ni | Si | O | N | B | C | Mn | Cr | H (ppm) | Co | Sb |

1) Unit of chemical composition is wt. % exept for H

From these hot-rolled sheets of alloys No. 1 through No. 23, the alloy sheets of No. 1 through No. 34 listed on Table 8 and Table 9 were prepared.

In Table 8 and Table 9, Dmax represents the maximum austenite grain size in alloy sheet, and Drain represents the minimum austenite grain size in the alloy sheet.

TABLE 8

| Material No. | Alloy No. | Average grain size Dav (μm) | Dmax/ Dmin | Vickers hardness before annealing before press-forming (Hv) | 10 × Dav + 80 − Hv | Hv − 10 × Dav − 50 | Type of example |
|---|---|---|---|---|---|---|---|
| 1 | 1 | 11.7 | 5.1 | 180 | Positive | Positive | Present invention |
| 2 | 2 | 11.7 | 15.0 | 181 | Positive | Positive | Present invention |
| 3 | 3 | 11.9 | 6.4 | 176 | Positive | Positive | Present invention |
| 4 | 4 | 12.5 | 13.0 | 205 | 0 | Positive | Present invention |
| 5 | 5 | 12.5 | 8.2 | 174 | Positive | Positive | Present invention |
| 6 | 6 | 12.4 | 11.1 | 190 | Positive | Positive | Present invention |
| 7 | 7 | 11.2 | 5.5 | 191 | 0 | Positive | Present invention |
| 8 | 8 | 13.7 | 15.0 | 187 | Positive | Positive | Present invention |
| 9 | 9 | 11.5 | 11.9 | 165 | Positive | Positive | Present invention |
| 10 | 10 | 10.6 | 9.1 | 186 | 0 | Positive | Present invention |
| 11 | 11 | 10.8 | 10.2 | 165 | Positive | Positive | Present invention |
| 12 | 12 | 14.0 | 11.8 | 218 | Positive | Positive | Present invention |
| 13 | 13 | 15.0 | 9.7 | 220 | Positive | Positive | Present invention |
| 14 | 14 | 12.6 | 5.5 | 178 | Positive | Positive | Present invention |
| 15 | 15 | 12.7 | 7.1 | 180 | Positive | Positive | Present invention |
| 16 | 16 | 12.5 | 6.3 | 176 | Positive | Positive | Present invention |
| 17 | 17 | 13.0 | 6.7 | 201 | Positive | Positive | Present invention |

TABLE 9

| Material No. | Alloy No. | Average grain size Dav (μm) | Dmax/ Dmin | Vickers hardness before annealing before press-forming (Hv) | 10 × Dav + 80 − Hv | Hv − 10 × Dav − 50 | Type of example |
|---|---|---|---|---|---|---|---|
| 18 | 18 | 10.6 | 14.2 | 185 | Positive | Positive | Comparative example |
| 19 | 19 | 8.9 | 19.6 | 176 | Negative | Positive | Comparative example |
| 20 | 20 | 10.5 | 14.9 | 173 | Positive | Positive | Comparative example |
| 21 | 21 | 9.0 | 18.6 | 180 | Negative | Positive | Comparative example |
| 22 | 22 | 10.0 | 20.2 | 182 | Negative | 0 | Comparative example |
| 23 | 23 | 10.0 | 10.0 | 161 | Positive | Positive | Comparative example |
| 24 | 1 | 15.6 | 14.0 | 206 | Positive | Positive | Comparative example |
| 25 | 1 | 9.5 | 14.6 | 170 | Positive | Positive | Comparative example |
| 26 | 2 | 10.5 | 22.0 | 180 | Positive | Positive | Comparative example |
| 27 | 5 | 11.0 | 14.1 | 226 | Negative | Positive | Comparative example |
| 28 | 2 | 10.9 | 13.5 | 163 | Positive | Positive | Comparative example |
| 29 | 6 | 11.9 | 15.0 | 200 | Negative | Positive | Comparative example |
| 30 | 6 | 13.3 | 12.0 | 176 | Positive | Negative | Comparative example |
| 31 | 4 | 10.8 | 16.8 | 170 | Positive | Positive | Comparative example |
| 32 | 3 | 11.5 | 6.3 | 186 | Positive | Positive | Comparative example |
| 33 | 4 | 10.9 | 6.0 | 167 | Positive | Positive | Comparative example |
| 34 | 7 | 11.1 | 13.0 | 190 | Positive | Positive | Comparative example |

The alloy sheets of materials No. 1 through No. 21 and No. 7 through No. 30 prepared from the hot-rolled alloy sheets No. 1 through No. 21 had the thickness of 0.13 mm and were produced by the process (1) given below.

(1) annealing of hot-rolled sheet in the temperature range of 910° to 990° C.—primary cold-rolling—recrystallization annealing in the temperature range of 860° to 940° C. for 125 sec.—secondary cold-rolling—recrystallization annealing in the temperature range of 860° to 940° C. for 125 sec.—finish cold-rolling at the reduction ratio of 15%—stress relief annealing at 530° C. for 30 sec.

The alloy sheets of materials No. 22 and No. 26 prepared from the hot-rolled sheets of alloys No. 22 and No. 26 had the thickness of 0.13 mm and were produced by the process (2) given below.

(2) primary cold-rolling at the reduction ratio of 92.5%—recrystallization annealing at 850° C. for 60 sec.—finish cold-rolling at the reduction ratio of 15%—stress relief annealing at 530° C. for 30 sec.

The alloy sheet of material No. 23 prepared from the hot-rolled sheet of alloy No. 23 had the thickness of 0.13 mm and was produced by the process (3) given below.

(3) annealing of the hot-rolled sheet at 970° C.—primary cold-rolling—recrystallization annealing at 860° C. for 30 sec.—secondary cold-rolling—recrystallization annealing at 860° C. for 30 sec.—finish cold-rolling—stress relief annealing at 530° C. for 30 sec.

The alloy sheet of material No. 24 prepared from the hot-rolled sheet of alloy No. 1 had the thickness of 0.13 mm and was produced by the process (4) given below.

(4) annealing of the hot-rolled sheet at 950° C.—primary cold-rolling at the reduction ratio of 74%—recrystallization annealing at 950° C. for 180 sec.—secondary cold-rolling at the reduction ratio of 40%—recrystallization at 950° C. for 180 sec.—finish cold-rolling at the reduction ratio of 15%—stress relief annealing at 530° C. for 30 sec.

The alloy sheets of materials No. 25 prepared from the hot-rolled sheet of alloy No. 1 had the thickness of 0.13 mm and was produced by the process (5) given below.

(5) annealing of the hot-rolled sheet at 950° C.—primary cold-rolling—recrystallization annealing at 800° C. for 30 sec.—secondary cold-rolling—recrystallization annealing at 800° C. for 30 sec.—finish cold-rolling—stress relief annealing at 530° C. for 30 sec.

The alloy sheets of materials No. 31 and No. 33 prepared from the hot-rolled sheet of alloy No. 4, and the alloy sheet of material No. 32 prepared from the hot-rolled sheet of alloy No. 3, and the alloy sheet of material No. 34 prepared from the hot-rolled sheet of alloy No. 7 had the thickness of 0.13 mm and were produced by the process (6) given below.

(6) primary cold-rolling—recrystallization annealing in the temperature range of 860° to 940° C. for 125 sec.—secondary cold-rolling—recrystallization annealing in the temperature range of 860° to 940° C. for 125 sec.—finish cold-rolling—stress relief annealing at 530° C. for 30 sec.

All those produced hot-rolled sheets showed sufficient recrystallization after annealing.

The alloy sheets of materials No. 1 through No. 12 and No. 15 through No. 34 prepared by the treatment described above were etched and formed into fiat masks (shadow masks before the press-forming). The fiat masks were treated by the annealing before press-forming at 770° C. for 45 min., followed by press-forming. The press-formability was tested during the procedure. Partial color-phase shift was measured after blackening the press-formed shadow masks, assembling them into cathode ray tubes, and irradiating an electron beam on the surface thereof. The alloy sheets of materials No. 13 and No. 14 were subjected to the annealing before press-forming at 795° C. for 3 min., which were then etched and formed into fiat masks. Those flat masks were press-formed to determine the press-formability. Those alloys were also checked for the partial color-phase shift using the same procedure as before.

Table 8 and Table 9 give the average austenite grain size, Dav, before annealing before press-forming, the degree of austenite mixed grain, Dmax/Dmin, the Vickers hardness, Hv, and identification of the sign of [10×Dav+80−Hv] and [Hv−10×Dav−50]. Table 10 and Table 11 give the degree of each plane on the sheet surface before the annealing before press-forming, the press-formability, the partial color-phase shift, and the corrosion resistance.

In Table 10 and Table 11, the criteria for evaluation of the shape fix ability, the fitness of dies and alloy sheet, and the blurred periphery of pierced hole are the following.

Regarding the shape fixability, "◎" mark indicates "very good", "○" indicates "good", and "X" indicates "rather poor".

As for the fitness of dies and alloy sheet, "○" mark indicates "good without ironing mark", "Δ" indicates "rather poor with a few ironing marks", and "X" indicates "poor with lots of ironing marks".

For the blurred periphery of pierced hole, "◎" mark indicates "definitely none", "○" indicates "none", "Δ" indicates "found some", and "X" indicates "generated".

The spot rust frequency is the number of spot corrosions per 1 $cm^2$ of the alloy surface, determined by the salt water spray test for 50 hours in accordance with JIS Z 2371.

TABLE 10

| Material No. | Alloy No. | Gathering degree of the crystal plane on the alloy sheet before anneqaling before press-forming {111} | {100} | {110} | {311} | {331} | {210} | {211} | Press-formability: Shape fix ability | Fitness to die | Cracking on the alloy sheet | Blurred periphery of pierced hole | Partial color phase shift | Corrosion resistance Generation of spot rust | Type of examples |
|---|---|---|---|---|---|---|---|---|---|---|---|---|---|---|---|
| 1 | 1 | 9 | 17 | 23 | 14 | 12 | 13 | 12 | ◎ | ○ | None | ◎ | None | 5 | Present invention |
| 2 | 2 | 2 | 75 | 8 | 2 | 7 | 3 | 3 | ◎ | ○ | None | ○ | None | 5 | Present invention |
| 3 | 3 | 5 | 27 | 30 | 12 | 7 | 11 | 8 | ◎ | ○ | None | ◎ | None | 3 | Present invention |
| 4 | 4 | 3 | 64 | 14 | 6 | 7 | 4 | 2 | ○ | ○ | None | ○ | None | 5 | Present invention |
| 5 | 5 | 7 | 35 | 23 | 13 | 8 | 10 | 4 | ○ | ○ | None | ◎ | None | 2 | Present invention |
| 6 | 6 | 6 | 50 | 16 | 7 | 9 | 5 | 5 | ◎ | ○ | None | ○ | None | 2 | Present invention |
| 7 | 7 | 9 | 20 | 28 | 10 | 10 | 11 | 10 | ○ | ○ | None | ◎ | None | 5 | Present invention |
| 8 | 8 | 4 | 5 | 37 | 17 | 12 | 13 | 12 | ○ | ○ | None | ○ | None | 5 | Present invention |
| 9 | 9 | 4 | 53 | 15 | 8 | 9 | 6 | 5 | ○ | ○ | None | ○ | None | 5 | Present invention |
| 10 | 10 | 6 | 43 | 21 | 9 | 9 | 7 | 5 | ○ | ○ | None | ◎ | None | 1 | Present invention |
| 11 | 11 | 11 | 8 | 30 | 15 | 11 | 12 | 13 | ○ | ○ | None | ◎ | None | 4 | Present invention |
| 12 | 12 | 10 | 7 | 34 | 16 | 12 | 10 | 11 | ○ | ○ | None | ○ | None | 5 | Present invention |
| 13 | 13 | 7 | 46 | 17 | 8 | 9 | 6 | 5 | ○ | ○ | None | ◎ | None | 1 | Present invention |
| 14 | 14 | 9 | 24 | 29 | 10 | 9 | 9 | 10 | ◎ | ○ | None | ◎ | None | 0 | Present invention |
| 15 | 15 | 7 | 29 | 24 | 10 | 10 | 10 | 10 | ◎ | ○ | None | ◎ | None | 5 | Present invention |
| 16 | 16 | 7 | 24 | 32 | 11 | 9 | 8 | 9 | ◎ | ○ | None | ◎ | None | 4 | Present invention |
| 17 | 17 | 5 | 30 | 35 | 8 | 8 | 8 | 6 | ◎ | ○ | None | ◎ | None | 0 | Present invention |

TABLE 11

| Material No. | Alloy No. | Gathering degree of the crystal plane on the alloy sheet before anneqaling before press-forming {111} | {100} | {110} | {311} | {331} | {210} | {211} | Press-formability: Shape fix ability | Fitness to die | Cracking on the alloy sheet | Blurred periphery of pierced hole | Partial color phase shift | Corrosion resistance: Generation of spot rust | Type of examples |
|---|---|---|---|---|---|---|---|---|---|---|---|---|---|---|---|
| 18 | 18 | 2 | 64 | 12 | 7 | 8 | 5 | 2 | o | x | None | o | None | 6 | Comparative example |
| 19 | 19 | 1 | 90 | 3 | 2 | 2 | 1 | 1 | x | o | Yes | x | Impossible to evaluate | 6 | Comparative example |
| 20 | 20 | 3 | 74 | 5 | 4 | 7 | 4 | 3 | o | x | None | o | None | 11 | Comparative example |
| 21 | 21 | 2 | 86 | 3 | 2 | 4 | 2 | 1 | x | o | Yes | x | Impossible to evaluate | 6 | Comparative example |
| 22 | 22 | 1 | 93 | 0 | 1 | 3 | 1 | 1 | x | o | Yes | x | Impossible to evaluate | 6 | Comparative example |
| 23 | 23 | 9 | 46 | 24 | 8 | 4 | 5 | 4 | x | o | Yes | ⊙ | Impossible to evaluate | 5 | Comparative example |
| 24 | 1 | 3 | 7 | 10 | 2 | 9 | 4 | 2 | x | o | None | o | Impossible to evaluate | 5 | Comparative example |
| 25 | 1 | 3 | 7 | 7 | 3 | 8 | 5 | 4 | x | o | None | o | Impossible to evaluate | 5 | Comparative example |
| 26 | 2 | 0 | 97 | 3 | 0 | 0 | 0 | 0 | o | o | None | x | Impossible to evaluate | 5 | Comparative example |
| 27 | 5 | 1 | 74 | 8 | 4 | 6 | 5 | 2 | x | o | None | o | Impossible to evaluate | 2 | Comparative example |
| 28 | 2 | 1 | 66 | 9 | 7 | 9 | 7 | 1 | x | o | None | o | Impossible to evaluate | 5 | Comparative example |
| 29 | 6 | 12 | 5 | 40 | 10 | 11 | 11 | 11 | x | o | None | o | Impossible to evaluate | 2 | Comparative example |
| 30 | 6 | 11 | 8 | 37 | 13 | 9 | 10 | 13 | x | o | None | o | Impossible to evaluate | 3 | Comparative example |
| 31 | 4 | 13 | 3 | 45 | 9 | 9 | 11 | 10 | o | o | None | Δ | Impossible to evaluate | 5 | Comparative example |
| 32 | 3 | 16 | 16 | 6 | 22 | 15 | 13 | 12 | o | o | None | o | Yes | 3 | Comparative example |
| 33 | 4 | 8 | 25 | 32 | 3 | 3 | 3 | 26 | o | o | Yes | o | None | 5 | Comparative example |
| 34 | 7 | 14 | 7 | 14 | 11 | 21 | 23 | 10 | o | o | None | o | Yes | 5 | Comparative example |

According to Table 8 through Table 10, Fe—Ni alloy sheets of materials No. 1 through No. 13 satisfied the conditions specified by the present invention, which conditions include the degree of planes, {111}, {100}, {110}, {311}, {331}, {210}, and {211}, the average austenite grain size, Dav, the degree of austenite mixed grain, Dmax/Dmin, the Vickers hardness, Hv, and the condition of [10×Dav+80≧Hv≧10×Dav+50]. All of those Fe—Ni alloy sheets gave an excellent press-formability without giving partial color-phase shift.

Also the Fe—Ni—Co alloy sheets of materials No. 14 through No. 17 satisfied the conditions specified by the present invention. All of those Fe—Ni—Co alloy sheets gave an excellent press-formability without giving partial color-phase shift.

Alloy sheets of materials No. 13 and No. 14 were subjected to annealing before press-forming before the etching. Even under the processing, those alloy sheets obtained the optimum functions as the shadow mask.

All of those alloy sheets of materials No. 1 through No. 17 clearly had superior characteristics to those of the Comparative materials which will be described below.

The alloy sheet of Comparative material No. 18 contained Si larger than the upper limit of the present invention, 0.2 wt. %. The alloy sheet of Comparative material No. 20 contained N more than the upper limit of the present invention, 0.003 wt. %. Both alloy sheets raised a problem of fitness with dies during press-forming.

The alloy sheet of Comparative material No. 19 contained O more than the upper limit of the present invention, 0.004 wt. %. The alloy sheet of Comparative material No. 23 contained Sb more than the upper limit of the present invention, 0.05 wt. %. Both alloy sheets gave the average austenite grain size, Dav, before the annealing before press-forming less than the lower limit of the present invention, 10.5 μm, gave a poor shape fixability at press-forming, and generated cracks on the sheet surface.

The alloy sheet of Comparative material No. 19 also gave the degree of austenite mixed grain, Dmax/Dmin, more than the upper limit of the present invention, 15, so it induced blurred periphery of pierced holes.

The alloy sheet of Comparative material No. 20 contained Co less than the lower limit of the present invention, 0.001 wt. %, so the corrosion resistance was significantly inferior to the Examples of the present invention.

The alloy sheet of Comparative material No. 21 contained B more than the upper limit of the present invention, 0.005 wt. %, so the average austenite grain size, Dav, before the annealing before press-forming was less than the lower limit of the present invention, 10.5 μm, and the shape fixability was poor, and generated cracks on the sheet surface. The alloy sheet of material No. 21 had the degree of austenite mixed grain, Dmax/Dmin, more than the upper limit of the present invention, 15, so the blurred periphery of pierced hole occurred.

The alloy sheet of Comparative material No. 22 was produced by the process (7) given below without employing hot-rolled annealing. The process employed is the same as disclosed in the Japanese Patent Unexamined Publication No. 3-267320 which was described before.

(7) primary cold-rolling at the reduction ratio of 92.5%—recrystallization annealing at 850° C. for 60 sec.—finish cold-rolling at the reduction ratio of 15%—stress relief annealing at 530° C. for 30 sec.

The alloy sheet of Comparative material No. 22 gave the degree of {100} plane above the upper limit of the present invention, 75%, and gave the degree of {110} plane below the lower limit of the present invention, 5%, and further gave the degree of austenite mixed grain, Dmax/Dmin, above the upper limit of the present invention, 15.

The alloy sheet of Comparative material No. 24 was subjected to recrystallization annealing at 950° C. for 180 sec. after the primary cold-rolling and the secondary cold-rolling. The alloy sheet of Comparative material No. 25 was subjected to recrystallization annealing at 800° C. for 30 sec. after the primary cold-rolling and the secondary cold-rolling. The alloy sheet of material No. 24 gave the average austenite grain size, Dav, before the annealing before press-forming more than the upper limit of the present invention, 15 μm, and the alloy sheet of material No. 25 gave the value less than the lower limit of this invention, 10.5 μm. Both alloy sheets showed poor shape fixability at press-forming.

The alloy sheet of Comparative material No. 26 was produced by the process employed for the preparation of the alloy sheet of No. 22. The alloy sheet gave the degree of {100} plane more than the upper limit of the present invention, 75%, gave the degree of {110} plane less than the lower limit of the present invention, 5%, and gave the degree of austenite mixed grain, Dmax/Dmin, more than the upper limit of the present invention, 15. As a result, the alloy sheet generated blurred periphery of pierced hole. Consequently, even an alloy sheet which satisfies the specification of composition of the present invention, it can not give an excellent press-formability if it does not satisfy the conditions of the present invention on the degree of each plane and on the degree of austenite mixed grain, Dmax/Dmin.

The alloy sheet of Comparative material No. 27 gave the Vickers hardness, Hv, more than the upper limit of the present invention, 220. The alloy sheet of Comparative material No. 28 gave the Vickers hardness, Hv, less than the lower limit of the present invention, 165. The alloy sheet of Comparative material No. 29 gave the Vickers hardness, Hv, more than the value of (10×Dav+80) specified by the present invention. The alloy sheet of Comparative material No. 30 gave the Vickers hardness, Hv, less than the value of (10×Dav+50) specified by the present invention. As a result, all of these alloy sheets gave poor shape fixability.

The alloy sheets of Comparative materials No. 31 through No. 34 were produced by the process which was employed to prepare the alloy sheets of materials No. 1 through No. 21 without applying annealing of hot-rolled sheet. The alloy sheet of material No. 31 gave the degree of {110} plane more than the upper limit of the present invention, 40%, nd gave the degree of austenite mixed grain, Dmax/Dmin, more than the upper limit of the present invention, 15, so the sheet generated blurred periphery of pierced holes. The alloy sheet of material No. 32 gave the degree of {111} plane more than the upper limit of the present invention, 14%, and gave the degree of {311} plane more than the upper limit of the present invention, 20%, so the sheet induced partial color-phase shift. The alloy sheet of material No. 33 gave the degree of {211} plane more than the upper limit of the present invention, 20%, so the sheet generated cracks on the sheet surface. The alloy sheet of material No. 34 gave the degree of {33 1} plane and {210} plane more than the upper limit of the present invention, 20%, so the sheet induced partial color-phase shift.

As described in detail above, an alloy sheet for shadow mask having excellent press-formability and screen quality is obtained by producing an alloy sheet which satisfies the conditions specified in the present invention, which conditions include the composition of the alloy, the gathering degree of each plane of the alloy sheet before annealing before press-forming, the average austenite grain size, Dav, before the annealing before press-forming, the degree of austenite mixed grain, Dmax/Dmin, the Vickers hardness, Hv, and the relation of [10×Dav+80≧Hv≧10×Dav+50].

The present invention provides an alloy sheet for a shadow mask which has excellent shape fixability during press-forming, shows good fitness with dies, suppresses crack generation on the material, induces no blurred periphery of pierced hole, is free from color-phase shift, and has corrosion resistance.

The above described alloy sheets of the present invention offer favorable etching quality and press-formability even they are subjected to the annealing before press-forming before the etching. Accordingly, the present invention provides an additional advantage for the manufacturer of cathode ray tubes to eliminate the annealing before press-foraging if the supplier of tile alloy sheets carries out the annealing before press-forming in advance.

What is claimed is:

1. An alloy sheet for making a shadow mask, said alloy sheet having been formed by hot rolling a slab into a hot-rolled sheet, annealing the hot-rolled sheet at a temperature of 910° to 990° C., cold-rolling the annealed hot-rolled sheet into a cold-rolled sheet, recrystallization annealing the cold-rolled sheet, finish cold-rolling the recrystallization annealed sheet, strain relief annealing the finished cold-rolled sheet, annealing the strain relief annealed sheet and press-forming the annealed sheet, said alloy sheet consisting essentially of 34 to 38 wt. % Ni, 0.001 to 0.07 wt. % Si, 0.00005 to 0.001 wt. % B, 0.0001 to 0.003 wt. % O, 0.0001 to 0.002 wt. % or less N, and optionally C and Mn, with the balance being Fe and inevitable impurities;

said alloy sheet before said annealing of the strain relief annealed sheet and before said press-forming having the following properties:

(i) an average austenite grain size (Dav) of 10.5 to 15.0 μm, (ii) a ratio of a maximum size to a minimum size of austenite grains (Dmax/Dmin) of 1 to 15, (iii) a Vickers hardness (Hv) of 165 to 220 and satisfying a relation of $$10\times Dav+80\geqq Hv\geqq 10\times Dav+50,$$

(iv) a gathering degree of 14% or less for a {111} plane of said alloy sheet, (v) a gathering degree of 5 to 75% for a {100} plane of said alloy sheet, (vi) a gathering degree of 5 to 40% for a {110} plane of said alloy sheet, (vii) a gathering degree of 20% or less for a {311} plane of said alloy sheet, (viii) a gathering degree of 20% or less for a {331} plane of said alloy sheet, (ix) a gathering degree of 20% or less for a {210} plane of said alloy sheet, and (x) a gathering degree of 20% or less for a {211} plane of said alloy sheet.

2. The alloy sheet of claim 1, wherein said Ni content is 35 to 37 wt. %.

3. The alloy sheet of claim 2, wherein said Ni content is 35.5 to 36.5 wt. %.

4. The alloy sheet of claim 1, wherein said B content is 0.00005 to 0.0002 wt. %.

5. The alloy sheet of claim 1, wherein said ratio of the maximum size to the minimum size of austenite grains (Dmax/Dmin) is 1 to 10.

6. The alloy sheet of claim 1, wherein said gathering degree of {100} plane is 8 to 46.

7. The alloy sheet of claim 1, wherein said C is in an amount of is 0.0001 to 0.004 wt. %.

8. The alloy sheet of claim 1, wherein said Mn is in an amount of is 0.001 to 0.35 wt. %.

9. An alloy sheet for making a shadow mask, said alloy sheet having been formed by hot rolling a slab into a hot-rolled sheet, annealing the hot-rolled sheet at a temperature of 910° to 990° C., cold-rolling the annealed hot-rolled sheet into a cold-rolled sheet, recrystallization annealing the cold-rolled sheet, finish cold-rolling the recrystallization annealed sheet, strain relief annealing the finished cold-rolled sheet, annealing the strain relief annealed sheet and press-forming the annealed sheet, said alloy sheet consisting essentially of 34 to 38 wt. % Ni, 0.001 to 0.07 wt. % Si, 1 wt. % or less Co, 0.00005 to 0.001 wt. % B, 0.0001 to 0.003 wt. % O, 0.0001 to 0.002 wt. % N, and optionally C and Mn, with the balance being Fe and inevitable impurities;

said alloy sheet before said annealing of the strain relief annealed sheet and before said press-forming having the following properties:

(i) an average austenite grain size (Dav) of 10.5 to 15.0 μm, (ii) a ratio of a maximum size to a minimum size of austenite grains (Dmax/Dmin) of 1 to 5, (iii) a Vickers hardness (Hv) of 165 to 220 and satisfying a relation of $$10\times Dav+80\geqq Hv\geqq 10\times Dav+50,$$

(iv) a gathering degree of 14% or less for a {111} plane of said alloy sheet, (v) a gathering degree of 5 to 75% for a {100} plane of said alloy sheet, (vi) a gathering degree of 5 to 40% for a {110} plane of said alloy sheet, (vii) a gathering degree of 20% or less for a {311} plane of said alloy sheet, (viii) a gathering degree of 20% or less for a {331} plane of said alloy sheet, (ix) a gathering degree of 20% or less for a {210} plane of said alloy sheet, and (x) a gathering degree of 20% or less for a {211} plane of said alloy sheet.

10. The alloy sheet of claim 9, wherein said Ni content is 35 to 37 wt. %.

11. The alloy sheet of claim 10, wherein said Ni content is 35.5 to 36.5 wt. %.

12. The alloy sheet of claim 9, wherein said B content is 0.00005 to 0.0002 wt. %.

13. The alloy sheet of claim 9, wherein said ratio of the maximum size to the minimum size of austenite grains (Dmax/Dmin) is 1 to 10.

14. The alloy sheet of claim 9, wherein said degree of {100} plane is 8 to 46.

15. The alloy sheet of claim 9, wherein said C is in an amount of is 0.0001 to 0.004 wt. %.

16. The alloy sheet of claim 9, wherein said Mn is in an amount of is 0.001 to 0.35 wt. %.

17. An alloy sheet for making a shadow mask, said alloy sheet having been formed by hot rolling a slab into a hot-rolled sheet, annealing the hot-rolled sheet at a temperature of 910° to 990° C., cold-rolling the annealed hot-rolled sheet into a cold-rolled sheet, recrystallization annealing the cold-rolled sheet, finish cold-rolling the recrystallization annealed sheet, strain relief annealing the finished cold-rolled sheet, annealing the strain relief annealed sheet and press-forming the annealed sheet, said alloy sheet consisting essentially of 28 to 38 wt. % Ni, 0.001 to 0.07 wt. % Si, over 1 wt. % to 7 wt. % Co, 0.0001 to 0.001 wt. % B, 0.0001 to 0.003 wt. % O, 0.0001 to 0.002 wt. % N, and optionally C and Mn, with the balance being Fe and inevitable impurities;

said alloy sheet before said annealing of the strain relief annealed sheet and before said press-forming having the following properties:

(i) an average austenite grain size (Dav) of 10.5 to 15.0 μm, (ii) a ratio of a maximum size to a minimum size of austenite grains (Dmax/Dmin) of 1 to 15, (iii) a Vickers hardness (Hv) of 165 to 220 and satisfying a relation of $$10\times Dav+80 \geqq Hv \geqq 10\times Dav+50,$$

(iv) a gathering degree of 14% or less for a {111} plane of said alloy sheet, (v) a gathering degree of 5 to 75% for a {100} plane of said alloy sheet, (vi) a gathering degree of 5 to 40% for a {110} plane of said alloy sheet, (vii) a gathering degree of 20% or less for a {311} plane of said alloy sheet, (viii) a gathering degree of 20% or less for a {331} plane of said alloy sheet, (ix) a gathering degree of 20% or less for a {210} plane of said alloy sheet, and (x) a gathering degree of 20% or less for a {211} plane of said alloy sheet.

18. The alloy sheet of claim 17, wherein said Ni content is 30 to 33 wt. % and said Co content is 3 to 6 wt. %.

19. The alloy sheet of claim 17, wherein said B content is 0.00005 to 0.0002 wt. %.

20. The alloy sheet of claim 17, wherein said ratio of the maximum size to the minimum size of austenite grains, Dmax/Dmin, is 1 to 10.

21. The alloy sheet of claim 17, wherein the gathering degree of {100} plane is 8 to 46.

22. The alloy sheet of claim 17, wherein said C is in an amount of is 0.0001 to 0.004 wt. %.

23. The alloy sheet of claim 17, wherein said Mn is in an amount of is 0.001 to 0.35 wt. %.

24. An alloy sheet for making a shadow mask, said alloy sheet having been formed by hot rolling a slab into a hot-rolled sheet, annealing the hot-rolled sheet at a temperature of 910° to 990° C., cold-rolling the annealed hot-rolled sheet into a cold-rolled sheet, recrystallization annealing the cold-rolled sheet, finish cold-rolling the recrystallization annealed sheet, strain relief annealing the finished cold-rolled sheet, annealing the strain relief annealed sheet and press-forming the annealed sheet, said alloy sheet consisting essentially of 34 to 38 wt. % Ni, 0.01 to 3 wt. % Cr, 0.001 to 0.2 wt. % Si, 0.00005 to 0.005 wt. % B, 0.0001 to 0.004 wt. % O, 0.0001 to 0.003 wt. % N, 0.05 wt. % or less Sb, and optionally C and Mn, with the balance being Fe and inevitable impurities;

said alloy sheet before said annealing of the strain relief annealed sheet and before said press-forming having the following properties:

(i) an average austenite grain size (Dav) of 10.5 to 15.0 μm, (ii) a ratio of a maximum size to a minimum size of austenite grains (Dmax/Dmin) of 1 to 15, (iii) a Vickers hardness (Hv) of 165 to 220 and satisfying a relation of $$10\times Dav+80 \geqq Hv \geqq 10\times Dav+50,$$

(iv) a gathering degree of 14% or less for a {111} plane of said alloy sheet, (v) a gathering degree of 5 to 75% for a {100} plane of said alloy sheet, (vi) a gathering degree of 5 to 40% for a {110} plane of said alloy sheet, (vii) a gathering degree of 20% or less for a {311} plane of said alloy sheet, (viii) a gathering degree of 20% or less for a {331} plane of said alloy sheet, (ix) a gathering degree of 20% or less for a {210} plane of said alloy sheet, and (x) a gathering degree of 20% or less for a {211} plane of said alloy sheet.

25. The alloy sheet of claim 24, wherein said Ni content is 35.5 to 37 wt. %.

26. The alloy sheet of claim 25, wherein said Ni content is 35.5 to 36.5 wt. %.

27. The alloy sheet of claim 24, wherein said B content is 0.00005 to 0.001 wt. %.

28. The alloy sheet of claim 24, wherein said ratio of the maximum size to the minimum size of austenite grains, Dmax/Dmin, is 1 to 10.

29. The alloy sheet of claim 24, wherein said degree of {100} plane is 8 to 46.

30. The alloy sheet of claim 24, wherein said C is in an amount of is 0.0001 to 0.01 wt. %.

31. The alloy sheet of claim 24, wherein said Mn is in an amount of is 0.001 to 0.5 wt. %.

32. The alloy sheet of claim 24, wherein said Sb is in an amount of is 0.005 to 0.05 wt. %.

33. An alloy sheet for making a shadow mask, said alloy sheet having been formed by hot rolling a slab into a hot-rolled sheet, annealing the hot-rolled sheet at a temperature of 910° to 990° C., cold-rolling the annealed hot-rolled sheet into a cold-rolled sheet, recrystallization annealing the cold-rolled sheet, finish cold-rolling the recrystallization annealed sheet, strain relief annealing the finished cold-rolled sheet, annealing the strain relief annealed sheet and press-forming the annealed sheet, said alloy sheet consisting essentially of 34 to 38 wt. % Ni, 0.01 to 3 wt. % Cr, 1 wt. % or less Co, 0.001 to 0.2 wt. % Si, 0.00005 to 0.005 wt. % B, 0.0001 to 0.004 wt. % O, 0.0001 to 0.003 wt. % N, 0.05 wt. % or less Sb, and optionally C and Mn, with the balance being Fe and inevitable impurities;

said alloy sheet before said annealing of the strain relief annealed sheet and before said press-forming having the following properties:

(i) an average austenite grain size (Dav) of 10.5 to 15.0 μm, (ii) a ratio of a maximum size to a minimum size of austenite grains (Dmax/Dmin) of 1 to 15, and a Vickers hardness (Hv) of 165 to 220 and satisfying a relation of $$10\times Dav+80 \geqq Hv \geqq 10\times Dav+50,$$

(iv) a gathering degree of 14% or less for a {111} plane of said alloy sheet, (v) a gathering degree of 5 to 75% for a {100} plane of said alloy sheet, (vi) a gathering degree of 5 to 40% for a {110} plane of said alloy sheet, (vii) a gathering degree of 20% or less for a {311} plane of said alloy sheet, (viii) a gathering degree of 20% or less for a {331} plane of said alloy sheet, (ix) a gathering degree of 20% or less for a {210} plane of said alloy sheet, and (x) a gathering degree of 20% or less for a {211} plane of said alloy sheet.

34. The alloy sheet of claim 33, wherein said Ni content is 35.5 to 37 wt. %.

35. The alloy sheet of claim 33, wherein said Ni content is 35.5 to 36.5 wt. %.

36. The alloy sheet of claim 33, wherein said B content is 0.00005 to 0.001 wt. %.

37. The alloy sheet of claim 33, wherein said ratio of the maximum size to the minimum size of austenite grains (Dmax/Dmin) is 1 to 10.

38. The alloy sheet of claim 33, wherein said gathering degree of {100} plane is 8 to 46.

39. The alloy sheet of claim 33, wherein said C is in an amount of is 0.0001 to 0.01 wt. %.

40. The alloy sheet of claim 33, wherein said Mn is in an amount of is 0.001 to 0.5 wt. %.

41. The alloy sheet of claim 33, wherein said Sb is in an amount of is 0.005 to 0.05 wt. %.

42. An alloy sheet for making a shadow mask, said alloy sheet having been formed by hot rolling a slab into a hot-rolled sheet, annealing the hot-rolled sheet at a temperature of 910° to 990° C., cold-rolling the annealed hot-rolled sheet into a cold-rolled sheet, recrystallization annealing the cold-rolled sheet, finish cold-rolling the recrystallization annealed sheet, strain relief annealing the finished cold-rolled sheet, annealing the strain relief annealed sheet and press-forming the annealed sheet, said alloy sheet consisting essentially of 25 to 38 wt. % Ni, 0.01 to 3 wt. % Cr, over 1 wt. % to 7 wt. % Co, 0.001 to 0.2 wt. % Si, 0.0001 to 0.005 wt. % B, 0.0001 to 0.004 wt. % O, 0.0001 to 0.003 wt. % or less N, 0.05 wt. % or less Sb, and optionally C and Mn, with the balance being Fe and inevitable impurities;

said alloy sheet before said annealing of the strain relief annealed sheet and before said press-forming having the following properties:

(i) an average austenite grain size (Dav) of 10.5 to 15.0 μm, (ii) a ratio of a maximum size to a minimum size of austenite grains (Dmax/Dmin) of 1 to 15, (iii) a Vickers hardness (Hv) of 165 to 220 and satisfying a relation of $$10\times Dav+80 \geqq Hv \geqq 10\times Dav+50,$$

(iv) a gathering degree of 14% or less for a {111} plane of said alloy sheet, (v) a gathering degree of 5 to 75% for a {100} plane of said alloy sheet, (vi) a gathering degree of 5 to 40% for a {110} plane of said alloy sheet, (vii) a gathering degree of 20% or less for a {311} plane of said alloy sheet, (viii) a gathering degree of 20% or less for a {331} plane of said alloy sheet, (ix) a gathering degree of 20% or less for a {210} plane of said alloy sheet, and (x) a gathering degree of 20% or less for a {211} plane of said alloy sheet.

43. The alloy sheet of claim 42, wherein said Ni content is 30 to 33 wt. % and said Co content is 3 to 6 wt. %.

44. The alloy sheet of claim 42, wherein said B content is 0.00005 to 0.001 wt. %.

45. The alloy sheet of claim 42, wherein said ratio of the maximum size to the minimum size of austenite grains (Dmax/Dmin) is 1 to 10.

46. The alloy sheet of claim 42, wherein said gathering degree of {100} plane is 8 to 46.

47. The alloy sheet of claim 42, wherein said C is in an amount of is 0.0001 to 0.01 wt. %.

48. The alloy sheet of claim 42, wherein Mn is in an amount of is 0.001 to 0.5 wt. %.

49. The alloy sheet of claim 42, wherein said Sb is in an amount of is 0.02 to 0.05 wt. %.

* * * * *